US011254133B2

(12) United States Patent
Arakane

(10) Patent No.: US 11,254,133 B2
(45) Date of Patent: Feb. 22, 2022

(54) PRINTING APPARATUS AND NON-TRANSITORY COMPUTER-READABLE RECORDING MEDIUM FOR PRINTING APPARATUS

(71) Applicant: Brother Kogyo Kabushiki Kaisha, Nagoya (JP)

(72) Inventor: Satoru Arakane, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/828,123

(22) Filed: Mar. 24, 2020

(65) Prior Publication Data

US 2020/0307218 A1 Oct. 1, 2020

(30) Foreign Application Priority Data

Mar. 28, 2019 (JP) ..... JP2019-062244

(51) Int. Cl.
*B41J 2/165* (2006.01)

(52) U.S. Cl.
CPC ..... *B41J 2/165* (2013.01); *B41J 2002/16502* (2013.01)

(58) Field of Classification Search
CPC ..... B41J 2/165; B41J 2002/16502
See application file for complete search history.

(56) References Cited

U.S. PATENT DOCUMENTS

2003/0234832 A1* 12/2003 Uchida ..... B41J 2/2107 347/36
2004/0036728 A1* 2/2004 Kawaguchi ..... B41J 2/1721 347/12
2007/0081770 A1 4/2007 Fisher

FOREIGN PATENT DOCUMENTS

JP 2006-338018 A 12/2006
JP 2008-149510 A 7/2008

* cited by examiner

*Primary Examiner* — Justin Seo
(74) *Attorney, Agent, or Firm* — Burr & Brown, PLLC

(57) ABSTRACT

A printing apparatus is provided with a print head having at least a first type nozzles and a second type nozzles positioned on a first direction side with respect to the first type of nozzles and a controller. The controller is configured to perform a first ejection control with performing a main scanning. The first ejection control includes a control of performing flushing when the print head is in a first state where the second type of nozzles are located at a position corresponding to an ink receiver and the first type of nozzles are located at a position corresponding to the medium range, and a control of causing the first type nozzles to eject the ink toward the printing medium during a period where the ink is ejected from the second type of nozzles toward the ink receiver when the print head is in the first state.

13 Claims, 16 Drawing Sheets

| | ELAPSED TIME Ta | FLUSHING AMOUNT V | CONTROL EXECUTED AT BEGINNING OF PRINTING (CT) |
|---|---|---|---|
| Rt1 | 0 ≤ Ta < T1 | 0 | CONTROL A |
| Rt2 | T1 ≤ Ta < T2 | V1 | CONTROL B |
| Rt3 | T2 ≤ Ta < T3 | V2 | CONTROL C |
| Rt4 | T3 ≤ Ta < T4 | V3 | CONTROL D |
| Rt5 | T4 ≤ Ta | V4 | CONTROL E |

FIG. 8

PRINTING APPARATUS AND NON-TRANSITORY COMPUTER-READABLE RECORDING MEDIUM FOR PRINTING APPARATUS

CROSS-REFERENCE TO RELATED APPLICATIONS

This application claims priority under 35 U.S.C. § 119 from Japanese Patent Application No. 2019-062244 filed on Mar. 28, 2019. The entire subject matter of the application is incorporated herein by reference.

BACKGROUND

Technical Field

The present disclosures relate to a printing apparatus configured to perform a partial printing in which ink droplets are ejected onto a printing sheet to form a partial image extending in a main scanning direction, and the partial printing is repeated to form a plurality of partial images arranged in a sub-scanning direction, which is perpendicular to the main scanning direction.

Related Art

There has been conventionally known an image forming apparatus which performs flushing, when the viscosity of the recording liquid in the nozzle increases. In an example of such an image forming apparatus, a cap member for capping nozzle surface and an ejected ink receiver are arranged in a non-printing area which is located on one side in the scanning direction of the carriage, on which a recording head is mounted, and another ejected ink receiver is arranged in a non-printing area on another side in the scanning direction. Flushing is performed when the nozzle of the recording head faces the ejected ink receiver. Typically, a plurality of nozzles are distributed both in the main scanning direction and in the sub-scanning direction, and even when the nozzles which are furthest from the printing area is located at a position facing the ejected ink receiver, the nozzles closest to the printing area are located in the non-printing area.

SUMMARY

In the above technique, since the flushing and the printing are performed separately (i.e., at different timings), when the flushing should be performed, the entire printing time may become elongated.

According to aspects of the present disclosures, there is provided a printing apparatus, provided with a print head having a plurality of types of nozzles including a first type nozzles configured to eject ink and a second type nozzles configured to eject ink, a main scanning mechanism configured to perform main scanning of moving the print head along a first direction and a second direction being opposite to the first direction with respect to a printing medium, a conveyer configured to convey, relative to the print head, the print medium along a conveying direction intersecting both the first direction and the second direction, an ink receiver arranged on the first direction side with respect to a medium range in which the printing medium conveyed by the conveyer, the medium range being a particular range in both the first direction and second direction in which the print head is configured to move, and a controller configured to control the print head, the main scanning mechanism and the conveyer. The second type nozzles are positioned on the first direction side with respect to the first type of nozzles. The controller is configured to perform a first ejection control with performing the main scanning. The first ejection control includes a control of performing flushing by causing the second type nozzles to eject the ink toward the ink receiver when the print head is in a first state where the second type of nozzles are located at a position corresponding to the ink receiver and the first type of nozzles are located at a position corresponding to the medium range, and a control of causing the first type nozzles to eject the ink toward the printing medium during a period in which the ink is ejected from the second type of nozzles toward the ink receiver when the print head is in the first state.

According to aspects of the present disclosures, there is provided a non-transitory computer-readable recording medium storing instructions to be executed by a controller of a printing apparatus, the printing apparatus including print head having a plurality of types of nozzles including a first type nozzles configured to eject ink and a second type nozzles configured to eject ink, a main scanning mechanism configured to perform main scanning of moving the print head along a first direction and a second direction being opposite to the first direction with respect to a printing medium, a conveyer configured to convey, relative to the print head, the print medium along a conveying direction intersecting both the first direction and the second direction, an ink receiver arranged on the first direction side with respect to a medium range in which the printing medium conveyed by the conveyer, the medium range being a particular range in both the first direction and second direction in which the print head is configured to move, the second type nozzles being positioned on the first direction side with respect to the first type of nozzles. Tue instructions cause, when executed by the controller, the printing apparatus to perform an obtaining function of obtaining image data, and a control function of controlling the print head, the main scanning mechanism, and the conveyer according to the image data, the control function being a first ejection control of causing the plurality of nozzles to eject the ink while performing the main scanning. The first ejection control includes a control of performing the flushing by causing the second type of nozzles to eject the ink toward the ink receiver when the print head is in a first state in which the second type of nozzles are located at a position corresponding to the ink receiver and the first type of nozzles are located at a position corresponding to the medium range, and a control of performing printing by causing the first type of nozzles to eject the ink toward the print medium during a period where the ink is ejected from the second type of nozzles toward the ink receiver when the print head is in the first state.

BRIEF DESCRIPTION OF THE ACCOMPANYING DRAWINGS

FIG. 1 is a block diagram showing a configuration of a printer according to an embodiment of the present disclosures.

FIG. 2 schematically shows a configuration of a printing mechanism.

FIG. 3 schematically shows a configuration of a print head viewed from a −Z side (i.e., a negative side along a Z-axis).

FIG. 8 shows an example of a control selection table.

DESCRIPTION

A. Embodiment

A-1. Configuration of Printer 200

Hereinafter, referring to the accompanying drawings, an embodiment according to aspects of the present disclosures will be described.

Figure 1:
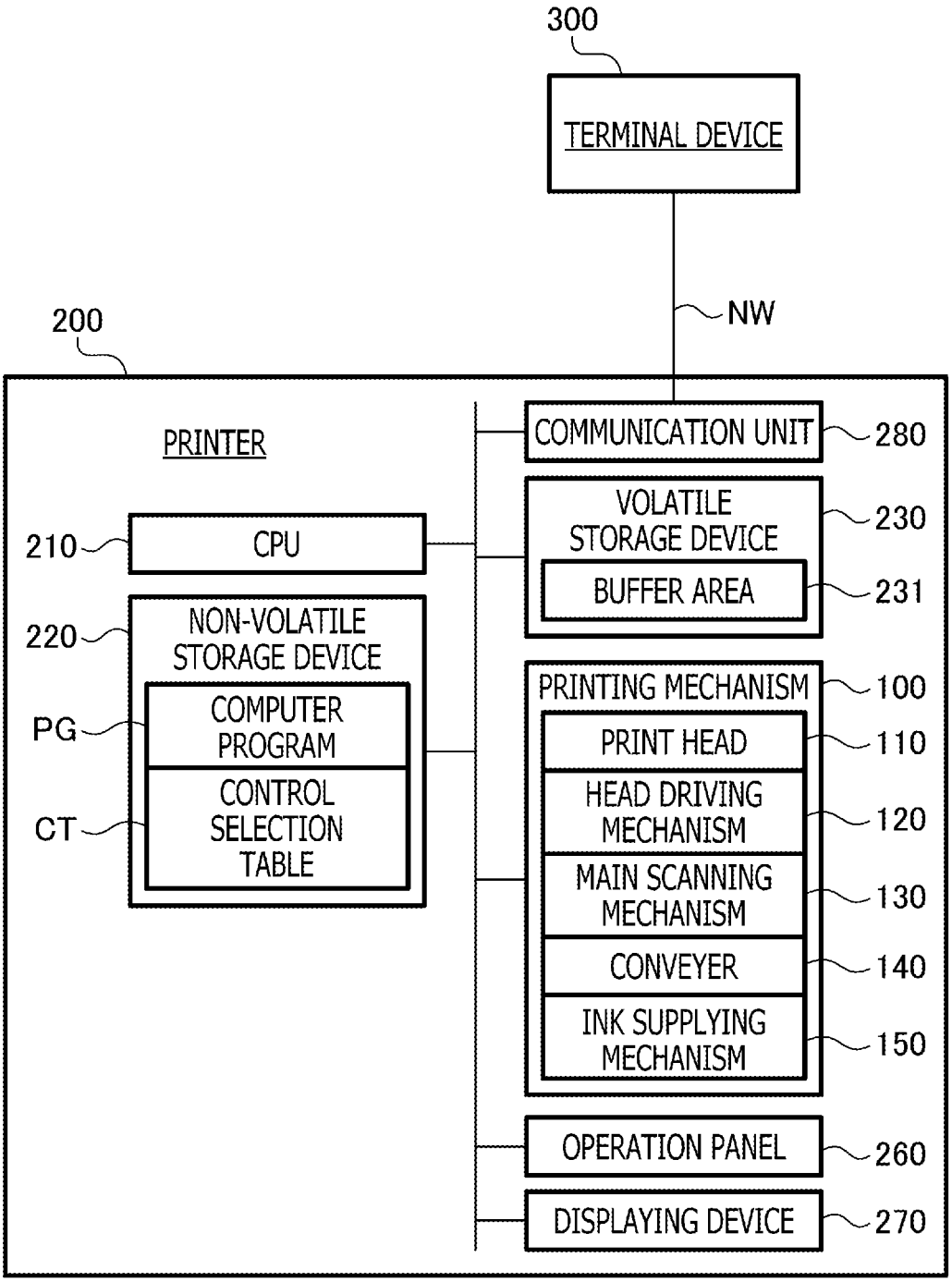

FIG. 1 is a block diagram showing a configuration of a printer 200 according to the embodiment. The printer 200 includes a printing mechanism 100, a CPU 210 serving as a controller of the printer 200, a non-volatile storage device 220 such as a hard disk drive, and a volatile storage device 230 such as a RAM. The printer 200 further includes an operation panel 260 provided with buttons and/or a touch panel for receiving operations by a user, a displaying device 270 such as a liquid crystal display, and a communication device 280. The communication device 280 includes a wired or wireless interface for connecting the printer 200 to a network NW. The printer 200 is communicably connected to an external device, e.g., a terminal device 300, via the communication device 280 and the network NW.

The volatile storage device 230 provides a buffer area 231 that temporarily stores various pieces of intermediate data which are generated when the CPU 210 performs processes. The non-volatile storage device 220 stores a computer program PG and a control selection table CT. The computer program PG, in this embodiment, is a control program for controlling the printer 200. The computer program PG and the control selection table CT may be provided such that they have been stored in the non-volatile storage device 220 when the printer 200 is shipped. Alternatively, the computer program PG and the control selection table CT may be downloadable from the servers, or provided in a form of DVD-ROM or the like. The CPU 210 performs, for example, a printing process by executing the computer program PG. Thus, the CPU 210 controls the printing mechanism 100 to print images on a printing medium (e.g., a printing sheet).

The printing mechanism 100 is configured to form dots on a printing sheet M using respective inks Ik (ink droplets) of cyan (C), magenta (M), yellow (Y) and black (K), thereby performing color printing. The printing mechanism 100 includes a print head 110, a head driving mechanism 120, a main scanning mechanism 130, a conveyer 140 and an ink supplying mechanism 150.

Figure 2:
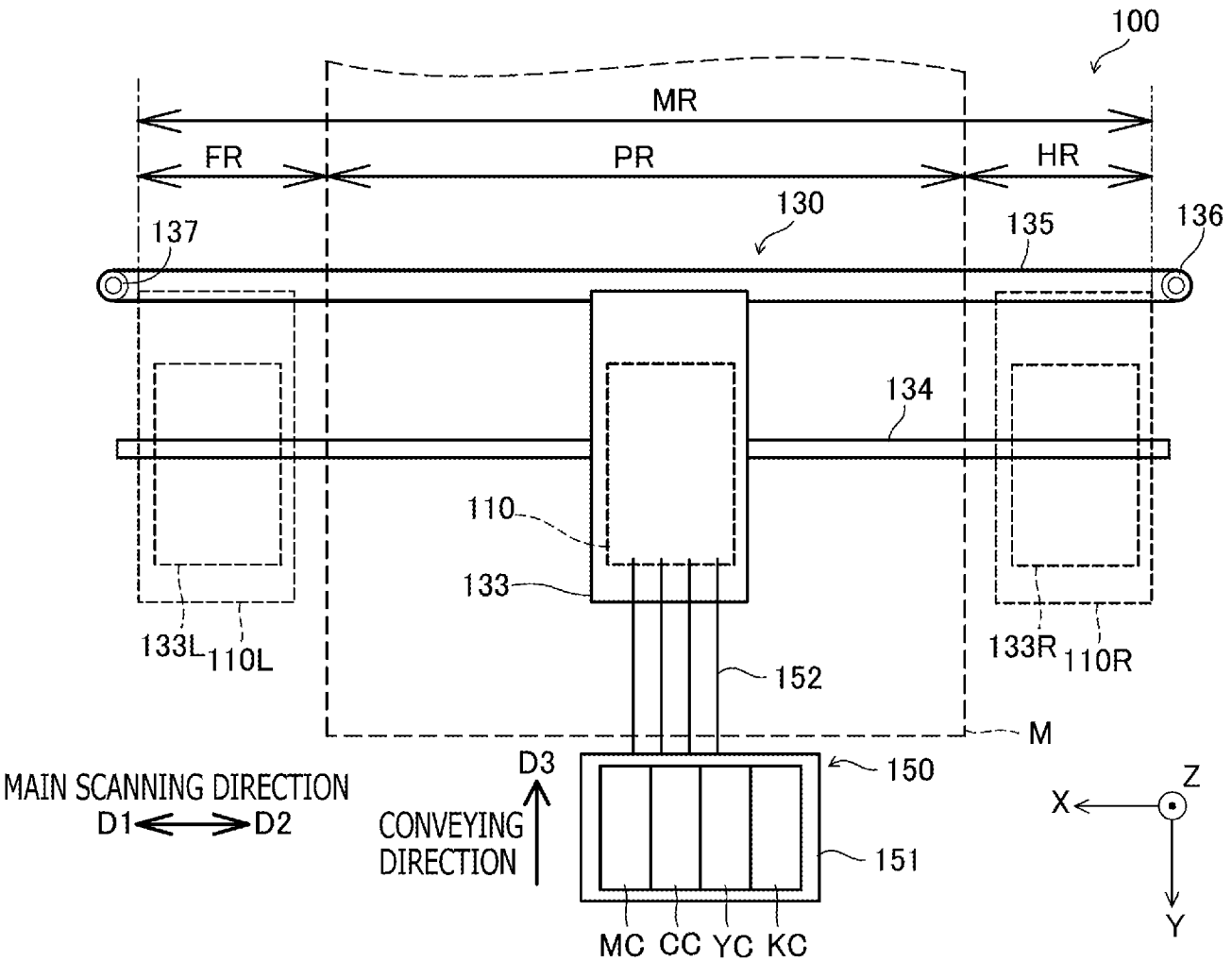

FIG. 2 schematically illustrates a configuration of the printing mechanism 100. As shown in FIG. 2, the main scanning mechanism 130 has a carriage 133, a slide shaft 134, a belt 135 and a plurality of pulleys 136 and 137. The carriage 133 mounts a print head 110 thereon. The slide shaft 134 slidably holds the carriage 133 so that the carriage 133 is slidable along a main scanning direction, which is an X-axis direction in FIG. 2. The belt 135 is wound around the pulleys 136 and 137 and the carriage 13 is secured to a part of the belt 135. The pulley 136 is driven by a main scan motor (not shown) to rotate. As the main scan motor rotates the pulley 136, the belt 135 moves and the carriage 133 is moved along the slide shaft 134. Accordingly, a main scanning of the print head 110 (i.e., a reciprocal movement of the print head 110 in the main scanning direction relative to the printing sheet M) is realized. It is noted that a direction of the main scanning is one of two one-way directions (e.g., from the right-hand side to the left-hand side, and from the left-hand side to the right-hand side in FIG. 2) along the main scanning direction, that is, a forward direction D1 (i.e., from the right-hand side to the left-hand side in FIG. 2), and a backward direction D2 (i.e., from the left-hand side to the right-hand side in FIG. 2), which is opposite to the forward direction D1, indicated by arrows in FIG. 2.

In FIG. 2, a range (also referred to as a movable range) MR in the main scanning direction in which the print head 110 is movable is illustrated. The movable range MR includes a sheet range PR, a home side range HR, and a flushing side range FR. The sheet range PR is a range, in the main scanning direction, in which the paper M conveyed by the conveyer 140 is positioned. The home side range HR and flushing side range FR are the ranges outside the sheet range PR.

The home side range HR is a range on the backward direction D2 side with respect to the sheet range PR and including a home position of the print head 110. The home position of the print head 110 is a position where the print head 110 stands by during, for example, a waiting period to wait for a print instruction. When the print head 110 is located at the home position, a nozzle-formed surface 111 of the print head 110 is covered with a nozzle cap (not shown).

The flushing side range FR is a range on the forward direction D1 side with respect to the sheet range PR and is a range in which an ink receiver 170 (not shown in FIG. 2) configured to receive the ink Ik, which is discharged from the printing head 110 when flushing is performed, is disposed.

In FIG. 2, the carriage 133 and the print head 110 when they have been moved to an end of the movable range MR in the forward direction D1 are illustrated by broken lines with reference numerals 133L and 110L, respectively. As is known from FIG. 2, the carriage 133 is movable such that an entire print head 110 can be positioned on the forward direction D1 side with respect to the sheet range PR and such that the entire print head 110 can be positioned on the backward direction D2 side with respect to the sheet range PR.

The conveyer 140 is configured to convey the sheet M in a conveying direction D3 (which is −Y direction, or an upward direction in FIG. 2) with holding the sheet M. In the following description, an upstream side along the conveying direction D3 (i.e., +Y side) may also be simply referred to as an upstream side, and a downstream side along the conveying direction D3 (i.e., −Y side) may also be simply referred to as a downstream side. Although not illustrated in detail, the conveyer 140 is provided with an upstream roller pair configured to hold the sheet on the upstream side with respect to the print head 110, a downstream roller pair configured to hold the sheet M on the downstream side with respect to the print head 110 and a motor. The conveyer 140 is configured to convey the sheet M by driving the upstream and downstream roller pairs with use of a driving force of the motor.

The ink supplying mechanism 150 supplies ink Ik to the print head 110. The ink supplying mechanism 150 includes a cartridge mounting section 151 and tubes 152. On the cartridge mounting section 151, a plurality of ink cartridges MC, CC, YC, and KC, which are containers respectively accommodating M (magenta), C (cyan), Y (yellow) and K (black) inks Ik therein, are detachably mounted. The inks Ik are supplied from the ink cartridges to the print head 110. The ink Ik in each ink cartridge is supplied to the print head 110 via the cartridge mounting section 151 and the tube 152.

Figure 3:
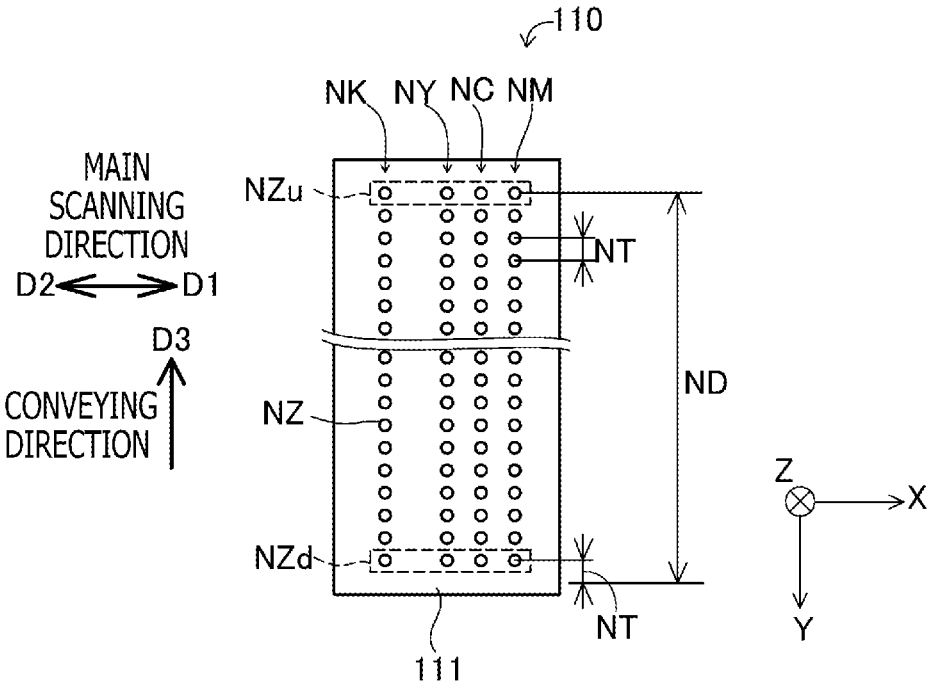

FIG. 3 shows a configuration of the print head 110 viewed from a −Z side. As shown in FIG. 3, the nozzle-formed surface 111 is a surface facing the sheet M which is being conveyed by the conveyer 140. On the nozzle-formed surface 111, a plurality of nozzle arrays each having a plurality of nozzles NZ are arranged. Specifically, on the nozzle-formed surface 111, nozzle arrays NK, NY, NC and NM respectively configured to eject the above-described C, M, Y and K inks Ik are formed. The plurality of nozzles NZ of each nozzle array are arranged at every particular nozzle interval NT along the conveying direction D3 at positions different from each other in the conveying direction D3 (−Y direction). The nozzle interval NT is the length, in the conveying direction D3, between two nozzles NZ adjacent to each other in the conveying direction D3.

Among the nozzles constituting each nozzle array, the nozzle NZ located at the most upstream side (+Y side) will also be referred to as a most upstream nozzle NZu. Further, among these nozzles of each nozzle array, the nozzle NZ located at the most downstream side (−Y side) will also be referred to as the most downstream nozzle NZd. A length obtained by adding the nozzle interval NT to a length, in the conveying direction D3, from the most upstream nozzle NZu to the most downstream nozzle NZd will be referred to as a nozzle array length ND.

The positions of the nozzle arrays NK, NY, NC and NM in the main scanning direction are different from each other. In the example shown in FIG. 3, the nozzle arrays NK, NY, NC and NM are arranged along the forward direction D1 (i.e., from the backward direction D2 side toward the forward direction D1 side) in this order. It is noted that the positions of the nozzle arrays NK, NY, NC and NM in the sub-scanning direction are overlapped with each other.

Each nozzle NZ is connected to an ink flow path (not shown) formed inside the print head 110. Further, an actuator (not shown; in this embodiment, a piezoelectric element) for causing each nozzle NZ to eject the ink Ik is provided along each ink flow path inside the print head 110.

The head driving mechanism 120 (see FIG. 1) is configured to drive each actuator inside the print head 110 according to the print data, which is supplied from the CPU 210 when the main scanning is performed by the main scanning mechanism 130. Thus, the Ink Ik is discharged from the nozzles NZ of the print head 110 onto the sheet M which is being conveyed by the conveyer 140. The head driving mechanism 120 causes each nozzle NZ to eject the ink Ik by supplying a driving signal to the actuator.

Figures 4A, 4B, 4C, 4D:
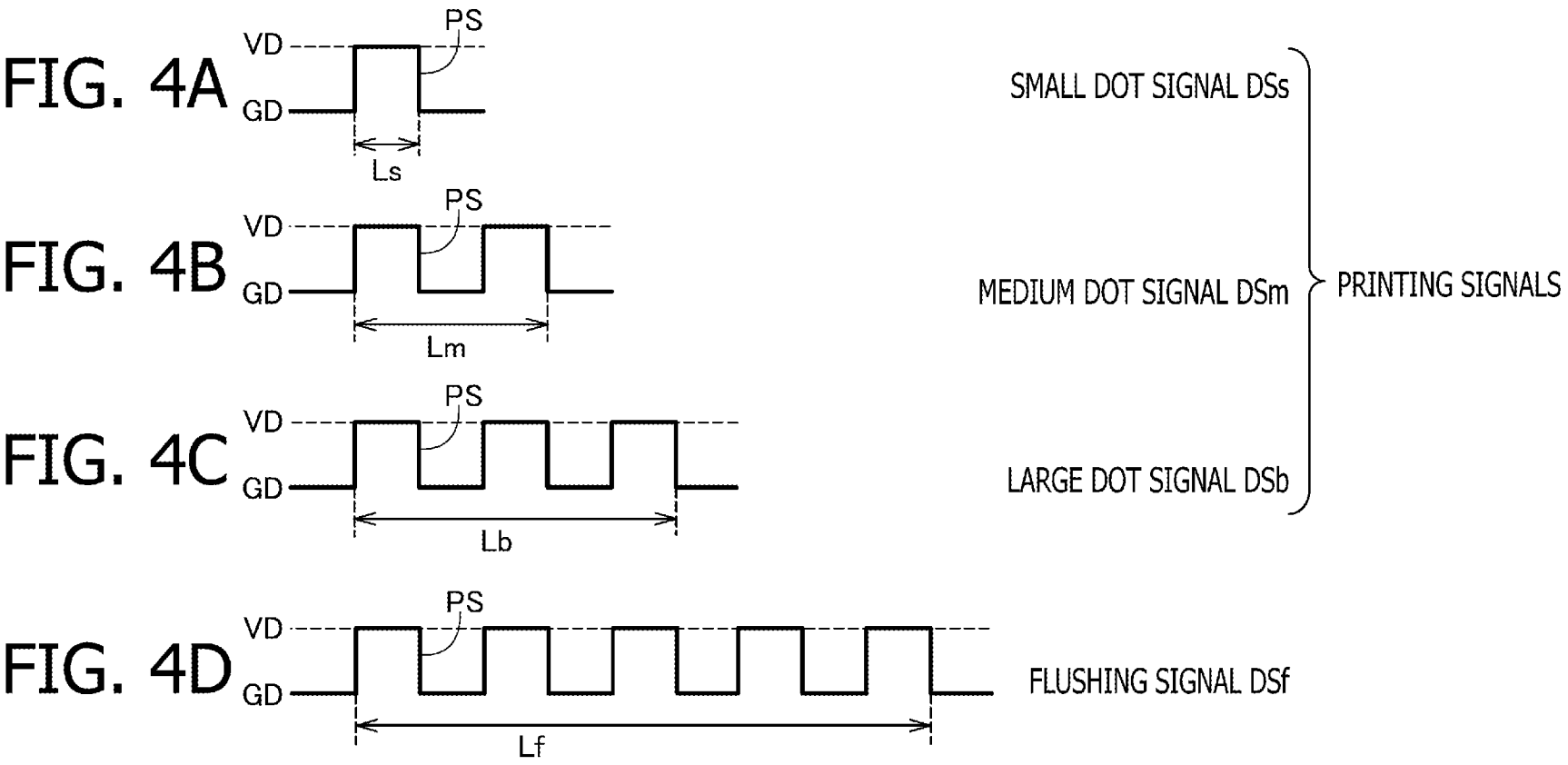
FIGS. 4A-4D show examples of a driving signal used to cause the print head to eject one ink drop.

FIGS. 4A-4D show examples of a driving signal for causing the nozzle Nz to discharge one ink droplet. The head driving mechanism 120 is configured to generate four types of driving signals and supply the same to each actuator. FIG. 4A shows a small dot signal DSs which is a drive signal for forming a small dot. The small dot signal DSs includes one pulse PS. FIG. 4B shows a medium dot signal DSm which is a drive signal for forming a medium dot. FIG. 4C shows a large dot signal DSb which is a drive signal for forming a large dot. The small dot signal DSs, the medium dot signal DSm and the large dot signal DSb, which are driving signals for printing (i.e., forming dots) will also be collectively referred to as printing signals.

FIG. 4D shows a flushing signal DSf which is a dedicated drive signal for flushing. The numbers of pulses PS included in the drive signals DSs, DSm, DSb and DSf shown in FIGS. 4A, 4B, 4C and 4D are 1, 2, 3 and 5, respectively. It is noted that the numbers of pulses PS shown in FIGS. 4A-4D are only examples and are not necessarily be limited to those numbers. For example, the numbers of pulses of the drive signals DSs, DSm, DSb and DSf may be a set of other numbers such as 1, 3, 6 and 8, respectively.

The greater the numbers of pulses PS included in the driving signals DSs, DSm, DSb and DSf are, the longer the wavelengths Ls, Lm, Lb and Lf of the driving signals DSs, DSm, DSb and DSf are. It is noted that the wavelengths Ls, Lm, Lb and Lf of the driving signals DSs, DSm, DSb and DSf do not indicate the wavelengths of the pulse PS, but the overall wavelengths of the driving signals (also referred to as the signal lengths). The ink ejection amount per one ink ejection operation is larger as the number of pulses PS is larger and the overall wavelength is longer. Accordingly, the ink amounts in one ink droplet ejected in accordance with the driving signals DSs, DSm, DSb and DSf are smaller to larger in this order. Therefore, the ink ejection amount per one ink ejection operation is larger when the flushing signal DSf is supplied than when the large dot signal DSb is supplied.

In the present embodiment, the head driving mechanism 120 supplies the ink to each of the nozzle arrays NK, NY, NC and NM at a driving frequency corresponding to the driving signals set as described above. For example, if the driving frequency is 5 Hz (Hertz), five driving signals are supplied to each nozzle NZ per one second. According to the present embodiment, the head driving mechanism 120 is configured to supply the driving signals to the nozzle arrays NK, NY, NC and NM at a common drive frequency. Therefore, the drive frequency cannot be changed for each nozzle array.

A-2. General Description of Printing Process

The CPU 210 is configured to print an image on the sheet M by performing a partial printing to cause the print head 110 to eject the ink Ik to form dots on the sheet M while causing the main scanning mechanism 130 to perform the main scanning, and a sub scanning to cause the conveyer 140 to convey the sheet M, alternately by a plurality of times.

Figure 5:
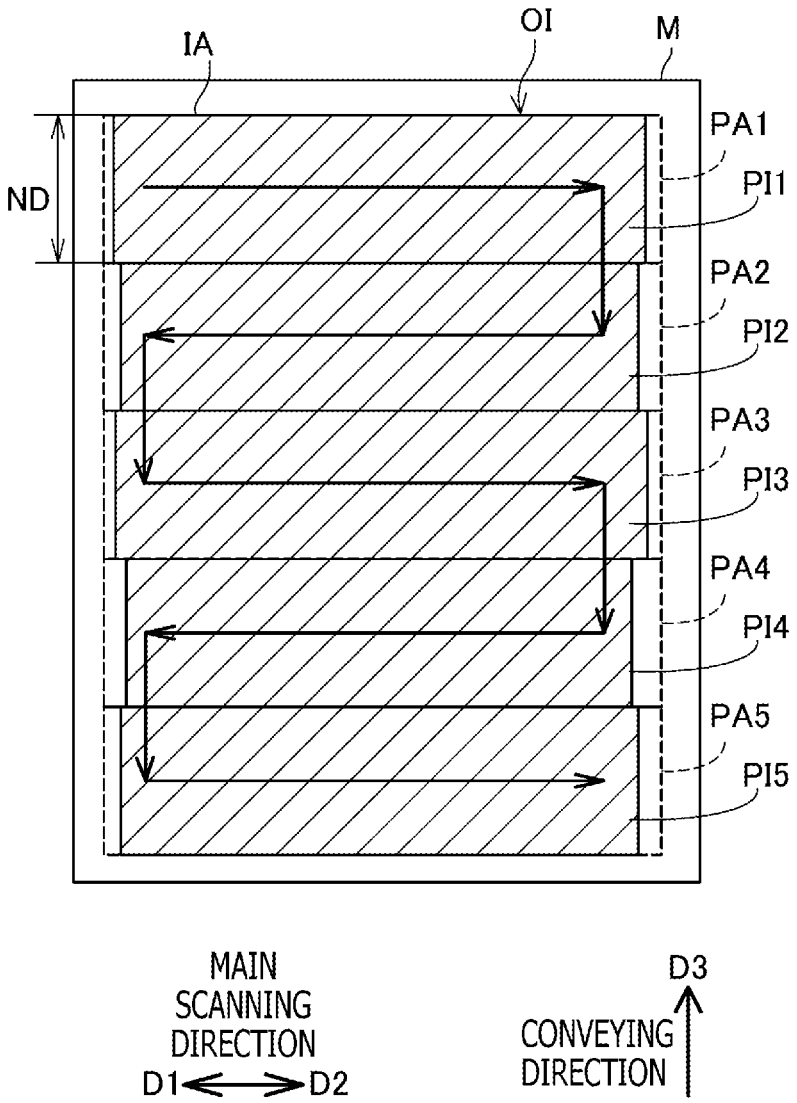
FIG. 5 is an explanatory view showing an operation of the printing mechanism.

FIG. 5 illustrates an operation of the printing mechanism 100. In FIG. 5, a printable range PA (i.e., PA1, PA2, PA3, PA4 and PA5) on the sheet M is indicated. The image OI is printed within the printable are PA on the sheet M. It is noted that the printable range PA includes a plurality of partial areas PA1-PA5. Further, the image OI includes a plurality of partial images PI1-PI5. Each partial area is an area in which an image is printed by one partial printing. Each partial image is an image to be printed by one partial printing. A printing direction of the partial printing is either the forward direction D1 or the backward direction D2. Arrow directed to the forward direction D1 or the backward direction D2 is indicated in each partial image in FIG. 5. The partial images PI1, PI3 and PI5, to which the arrow D1 is indicated, are printed in the forward direction D1, and the partial image PI2 and PI4 to which the arrow D2 is indicated is printed in the backward direction D2. As shown in FIG. 5, the printing mechanism 110 is configured to perform a bi-directional printing in which partial printing of the forward direction D1 and partial printing of the return direction D2 are executed alternately.

In FIG. 5, a downward-directed arrow from one partial image (e.g., the partial image PI1) toward downwardly adjacent another partial image (e.g., the partial image PI2) corresponds to conveyance of the sheet M (sub scanning). That is, each downward-directed arrow in FIG. 5 indicates that a position of the printing head 110 moves downward relative to the sheet M shown in FIG. 5 as the sheet M is conveyed in the conveying direction D3 (i.e., the upward direction in FIG. 5). As shown in FIG. 5, printing according to the present embodiment is a so-called one-pass printing, and a length, in the conveying direction D3, of each partial image and the conveying amount of one sheet M in the conveying direction D3 are equal to the nozzle length ND.

Incidentally, the configuration of printing illustrated in FIG. 5 is an example and the present disclosures should not be limited to this configuration. For example, one-way printing in which printing is performed only by the partial printing in the forward direction D1 may be employed, or a so-called multi-pass printing in which one partial image is printed by two or more partial printings may be employed.

A-3. Flushing

Figure 6A:
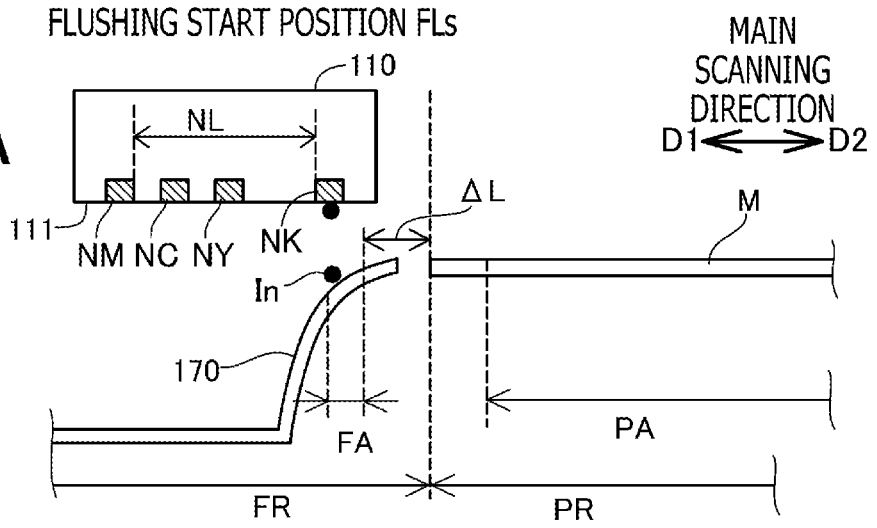
FIGS. 6A-6C are explanatory views illustrating flushing.
Figure 6B:
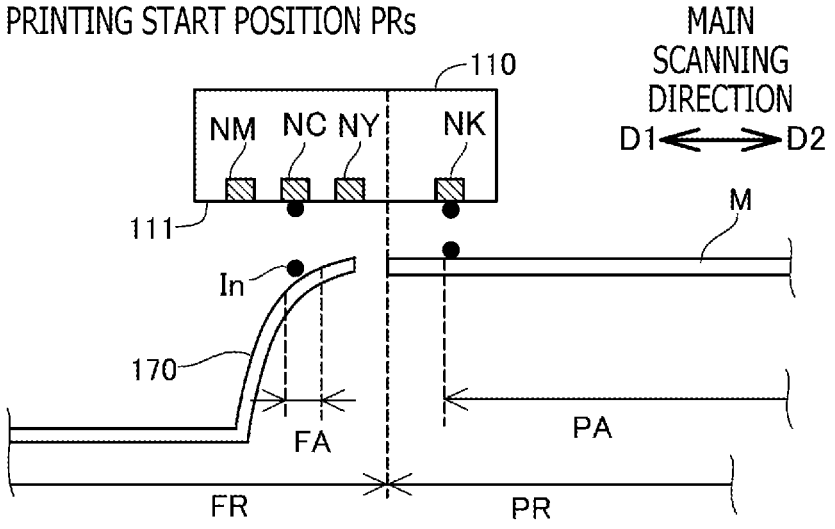
Figure 6C:
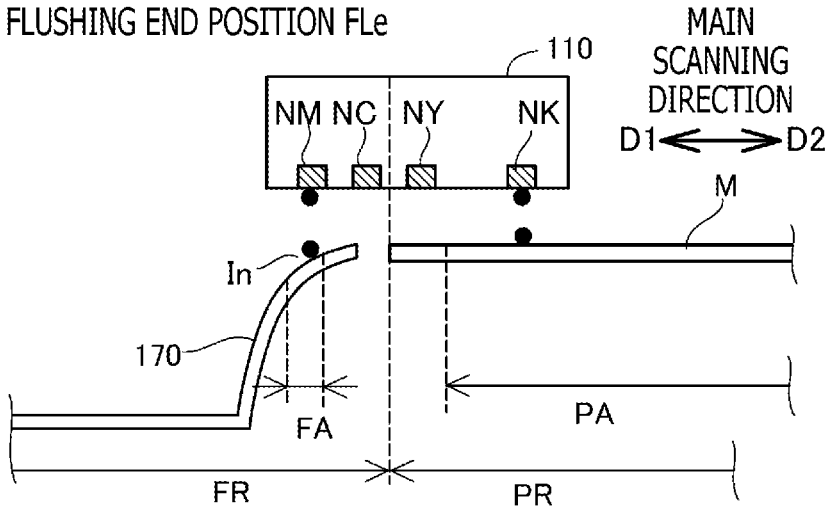

FIGS. 6A-6C show flushing when the printing head 110 is located at different positions. In each of FIGS. 6A-6C, only the print head 110, the sheet M and the ink receiver 170 are illustrated while other configurations such as the carriage 133 are omitted in order to avoid complication of the drawings. As shown in FIGS. 6A-6C, the flushing is an operation of causing the print head 110 to eject the ink Ik from each of the nozzles NZ to the ink receiver 170 within an ejection range FA. By performing the flushing, clogging of the nozzles NZ is suppressed. Clogging of the nozzles NZ causes a failure in which the ink Ik is not ejected from the nozzles NZ, or a failure in which a less amount of the ink Ik is discharged than assumed.

As shown in FIG. 6A, the ink receiver 170 is a member arranged to be inclined such that the forward direction D1 side thereof is low and the backward direction D2 side thereof is high. The ink Ik ejected within the ejection range FA (FIG. 6A) flows downward along a surface of the ink receiver 170. When the ink Ik is ejected on the forward direction D1 side with respect to the ejection range FA, since a distance from the nozzles NZ to the ink receiving portion 170 is excessively long, the ink Ik is decelerated by air resistance before the ink Ik reaches the ink receiver 170, and a problem that the ink Ik floats in the housing of the printer 200 may occur. When the ink Ik is ejected on the backward direction D2 side with respect to the ejection range FA, since the distance from the nozzles NZ to the ink receiver 170 is excessively short, a problem may occur in which the ejected ink Ik adheres to the nozzle-formed surface 111 as the ejected ink Ik rebounds on the surface of the ink receiver 170. Thus, the ejection range FA is limited to a relatively narrow range.

The ink receiver 170 is arranged within the flushing side range FR and in the vicinity of the sheet range PR (see FIGS. 6A-6C). A distance ΔL (see FIG. 6A), along the forward direction D1, from the ejection range FA of the ink receiver 170 to the an end of the sheet range PR in the forward direction D1 is shorter than an interval NL from the nozzle array NM, which is arranged at a most forward position in the forward direction D1, to the nozzle array NK, which is arranged at a most backward position in the backward direction D2.

The positions, in the main scanning direction, of the print head 110 shown in FIGS. 6A-6C are different from each other. In the following description, when a position is referred to as "a position of the print head 110," the position of the print head 110 in the main scanning direction (i.e., the position in the forward direction D1) is referred to.

FIG. 6A shows the print head 110 located at the flushing start position FLs. When located at the flushing start position, all the nozzles NZ of the print head 110 are located within the flushing side range FR, which is on the forward direction D1 side with respect to the sheet range PR. As shown in FIG. 6A, when the print head 110 is located at the flushing start position FLs, the nozzle array NK, which is located at the most backward side D2 among the nozzle arrays NK, NY, NC and NM, is located within the ejection range and can perform flushing. When the print head 110 is located at the flushing start position, none of the nozzle arrays NK, NY, NC and NM can eject the ink Ik toward the sheet M to form dots.

FIG. 6B shows the print head 110 located at a printing start position PRs. The printing start position PRs is on the backward direction D2 side with respect to the flushing start position FLs. As described above, the ink receiver 170 is arranged, within the flushing side range FR, in the vicinity of the sheet range PR. Thus, when the print head 110 is located at the printing start position PRs as shown in FIG. 6B, a forward direction D1 side portions of the print head 110 including the nozzle arrays MN, NC and NY is located within the flushing side range FR, while a backward direction D2 side of the print head 110 including the nozzle array NK is located within the sheet range PR. For example, as shown in FIG. 6B, the nozzle array NC is located within the ejection range FA, while the nozzle NK is located at an end, in the forward direction D1, of the printable range PA. In such a state where the print head 110 is located at the printing start position PRs, the print head 110 is capable of ejecting the ink Ik through the nozzle array NC towards the sheet M to form the dots on the sheet M with performing the flushing to eject the ink Ik from the nozzle array NC toward the ink receiver 170.

FIG. 6C shows the print head 110 located at a flushing end position FLe. The flushing end position FLe is on the backward direction D2 side with respect to the printing start position PRs. When the print head 110 is located at the flushing end position FLe as shown in FIG. 6C, a forward direction D1 side portion of the print head 110 including the nozzle arrays NM and NC is located within the flushing side range FR, while a backward direction D2 side portion of the print head 110 including the nozzle arrays NK and NY is located within the sheet range PR. The nozzle arrays NM is located within the ejection range FA and the nozzle array NK is located within the printable range PA. Therefore, when the head is located at the flushing end position FLe as shown in FIG. 6C, the print head 110 is capable of ejecting the ink Ik from the nozzle array NM toward the sheet M to form dots on the sheet M with performing the flushing to eject the ink Ik from the nozzle array NK toward the ink receiver 170.

When the print head 110 is located within a range from the flushing start position FLs (FIG. 6A) to the flushing end position FLe (FIG. 6C), the printing mechanism 100 is capable of performing flushing to eject the ink Ik from the nozzles NZ which are located at positions where the nozzles NZ can eject the ink Ik within the ejection range FA. For example, the printing mechanism 100 is capable of performing flushing with performing the main scanning of the print head 110 to move, in the backward direction D2, from the flushing start position FLs to the flushing end position FLe. Further, the printing mechanism 100 is also capable of performing flushing with performing the main scanning of the print head 110 to move, in the forward direction D1, from the flushing end position FLe to the flushing start position FLs. Hereinafter, the former will also be referred to a backward direction D2 flushing and the latter will also be referred to a forward direction D1 flushing. During the main scanning direction flushing, wherein the print head 110 is located within a range from the printing start position PRs (FIG. 6B) to the flushing end position FLe (FIG. 6C), the printing mechanism 100 is capable of ejecting the ink Ik from the nozzles NZ of the nozzle array NK toward the sheet M in parallel with the flushing. Accordingly, formation of the dots on the sheet M can be performed in parallel with the flushing.

A-4. Printing Process

Figure 7:
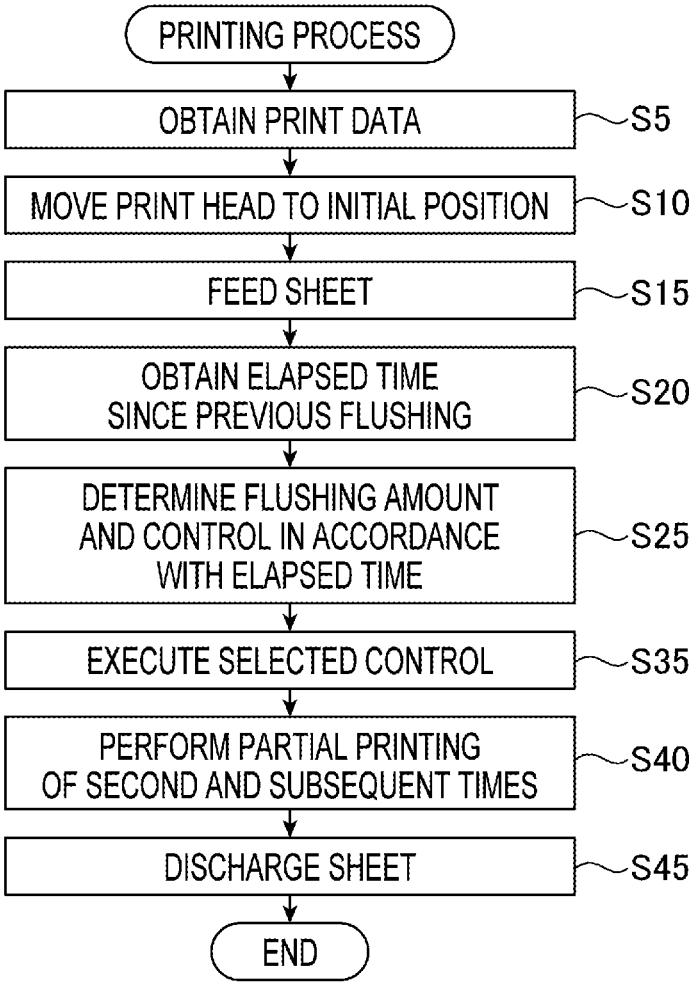
FIG. 7 is a flowchart illustrating a printing process according to the embodiment.

FIG. 7 shows a flowchart illustrating a printing process according to the embodiment of the present disclosures. The CPU 210 of the printer 200 starts the printing process when receiving a print instruction from, for example, the terminal device 300 (see FIG. 1).

In S5, the CPU 210 obtains the print data by receiving the print data from the terminal device 300. The print data is data (dot data) indicating, for example, a formation state of a dot for each color component and for each pixel. The forming state of the dot is, for example, one of "large dot," "medium dot," "small dot" or "no dot." Alternatively, the dot formation state may be either "with dot" or "without dot."

In S10, the CPU 210 controls the main scanning mechanism 130 to move the print head 110 to an initial position. In this embodiment, the flushing is performed, in principle, at the beginning of printing. Accordingly, at the beginning of printing, the CPU 210 moves the print head 110 to the flushing start position FLs. In S15, the CPU 210 controls the conveyer 140 to perform sheet feeding. In the sheet feeding, one sheet M is conveyed from a print sheet tray (not shown) to a particular initial position. In order to reduce a printing time, S10 and S15 are actually executed in parallel.

In S20, the CPU 210 obtains an elapsed time Ta since the previous flushing. Although omitted in the flowchart, each time when the CPU 210 causes the printing mechanism 100 to perform the flushing, the CPU 210 records the time when the flushing is performed in the non-volatile storage device 220. The CPU 210 obtains the elapsed time Ta by calculating the elapsed time from the recorded time to the present time.

In S25, the CPU 210 determines a flushing amount V and a control to be performed at the beginning of printing, in accordance with the elapsed time Ta. Determination of the flushing amount V and the control is made with reference to the control selection table CT (FIG. 1). FIG. 8 shows an example of the control selection table CT. In the control selection table CT, a correspondence relationship between the elapsed time Ta and the flushing amount V is recorded. Further, in the control selection table CT, a correspondence relationship between the flushing amount V and a type of control to be executed at the beginning of printing is recorded. In the example shown in FIG. 8, a range of the elapsed time Ta starting from zero is separated into a plurality of time ranges Rt1-Rt5. The time ranges Rt1-Rt5 are associated with, 0 and V1-V4, respectively, as the flushing amount V. Furthermore, in the control selection table CT, flushing amounts 0 and V1-V4 are associated with controls A-E, respectively.

Since the longer the elapsed time Ta is, the greater the degree of clogging of the nozzle NZ is, in order to eliminate the clogging of the nozzles NZ, the longer the elapsed time Ta is, the greater the amount of the ejected ink Ik should be. For this reason, the flushing amounts V recorded in the control selection table CT satisfies a relationship of $V1<V2<V3<V4$. Thus, the flushing amount V is determined so as to increase stepwise as the elapsed time Ta is elongated. For example, when the elapsed time Ta is within the range Rt4 (i.e., $T3<Ta<T4$), the flushing amount V is determined to be V3 and the control to be executed at the beginning of printing is determined to be a control D.

In S35, the CPU 210 performs the control determined, in S25, among the control A-control E. The control A, which is performed when the flushing amount V is 0, is a control for performing a first partial printing. The controls B-E, which are performed when the flushing amount V is V1-V4, respectively, are controls each of which performs the flushing and the first partial printing. At the time when S35 is completed, for example as shown in FIG. 5, printing of the partial image PI1, among the partial images PI1-PI5, is completed.

In S40, the CPU 210 performs a second and subsequent partial printings to complete the printing operation. In the example shown in FIG. 5, four subsequent partial printings are performed to print four partial images PI2-PI5.

In S45, the CPU 210 controls the conveyer 140 to perform a discharge operation, in which the sheet M, on which an image has been printed, is conveyed to a discharge tray (not shown).

A-5. Control at Beginning of Printing

Hereinafter, the controls A-E, which are performed in S35 of FIG. 7 at the beginning of the printing, will be described in detail. In each of the controls A-E, two types of frequencies (i.e., a printing frequency and a flushing frequency) are used as driving frequencies which are used when the head driving mechanism 120 supplies the driving signal (see FIG. 4) to the print head 110. The printing frequency is a frequency for forming dots, or a frequency for printing. The flushing frequency is a frequency dedicated for flushing. It is noted that the flushing frequency is lower than the printing frequency. The printing frequency is, for example, 20 kHz, while the flushing frequency is, for example, 10 kHz. The lower the frequency is, the longer the maximum wavelength of the driving signal for ejecting the ink Ik per one ejection could be. For example, by using the flushing frequency as the driving frequency, the flushing signal DSf (see FIG. 4D) having a longer wavelength than the large dot signal DSb (see FIG. 4C) can be used.

Formation of the dot needs to be performed in accordance with an interval based on a resolution, in the main scanning direction, of printing synchronous with the main scanning. For this purpose, the printing frequency is defined to be a value corresponding to an interval for formation of dots and a speed in the main scanning direction. When the dots are formed, only the printing frequency is used, and the flushing frequency is not used.

In the flushing, it is only necessary that the head driving mechanism 120 is caused to eject the ink Ik and it is not necessary that the ink ejection is performed at a particular interval. Accordingly, when the flushing is performed, either the printing frequency or the flushing frequency can be used. It is noted that, when the flushing frequency is used, the ink ejection amount per one ejection can be increased since the flushing signal DSf can be used. The more the ink ejection amount per one ejection is, the more efficiently the clogging of the nozzles NZ is eliminated. Accordingly, by increasing the ink ejection amount per one ejection, the flushing can be performed efficiently in a short period of time.

In the controls A-E, the printing speed and the flushing speed, which is slower than the printing speed, are used as the speed of the main scanning. The printing speed is a speed used at the time of printing, i.e., at the time of formation of the dots. Thus, the printing speed is adjusted so that a dot is formed at a desired position when the dot is formed with use of the printing frequency. At the time of dot formation, only the printing speed is used, and the flushing speed is not used. When the flushing is performed, either the printing speed or the flushing speed can be used. It should be noted that, when the flushing speed used, it is possible to lengthen the time during which the flushing can be performed. Accordingly, a larger amount of the ink Ik can be ejected in the flushing. The printing speed is, for example, 30 ips (inch per second) and the flushing speed is, for example, 4 ips.

In view of the characteristics described above, when only the formation of dots is performed and when the formation of dots and flushing are performed in parallel, the printing frequency is used as the driving frequency, the printing signal (FIGS. 4A-4C) is used as the driving signal, and the printing speed is used as the speed of the main scanning. When only the flushing is performed, the flushing frequency is used as the driving frequency, the flushing signal DSf (FIG. 4D) is used as the driving signal, and the flushing speed is used as the speed of the main scanning.

A-5-1. Control A

Figure 9A:
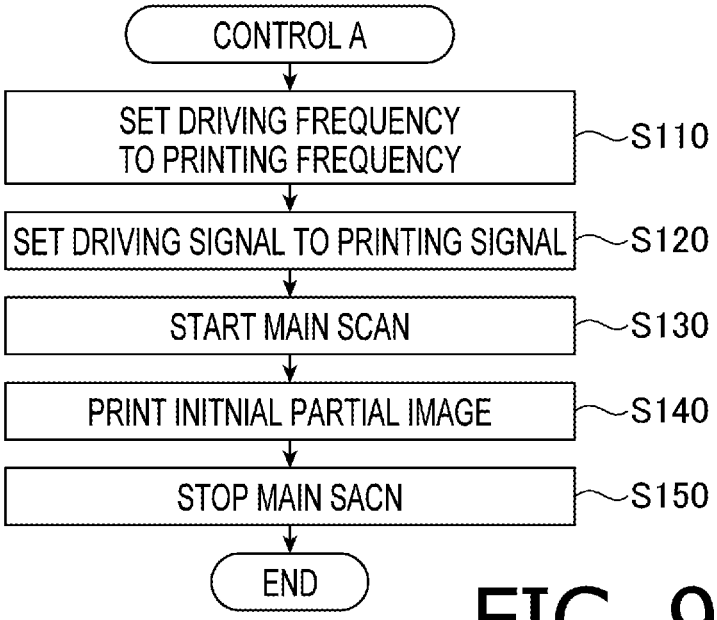
FIG. 9A is a flowchart illustrating a control A which is executed in the printing process.

FIG. 9A is a flowchart illustrating the control A, which is performed at the beginning of the printing. It is noted that the control A is a process to be selected when the flushing amount V is 0, i.e., when it is not necessary to perform the flushing (FIG. 8). For this reason, in S110 of FIG. 9A, the CPU 210 sets the driving frequency to the printing frequency. In S120, the CPU 210 sets the driving signal to the printing signal.

In S130, the CPU 210 controls the main scanning mechanism 130 to start the main scanning in the backward direction D2. The main scanning is performed at the printing speed. In S140, the CPU 210 controls the head driving mechanism 120 to print the first partial image P11. That is, the head driving mechanism 120 supplies the printing signals DSs, DSm and DSb to actuators of the nozzles NZ in accordance with the print data to cause the nozzles NZ to eject the ink Ik. In S150, the CPU 210 controls the head driving mechanism 120 to stop the main scanning in the backward direction D2. According to the above control, the first partial printing is completed.

Figure 9B:
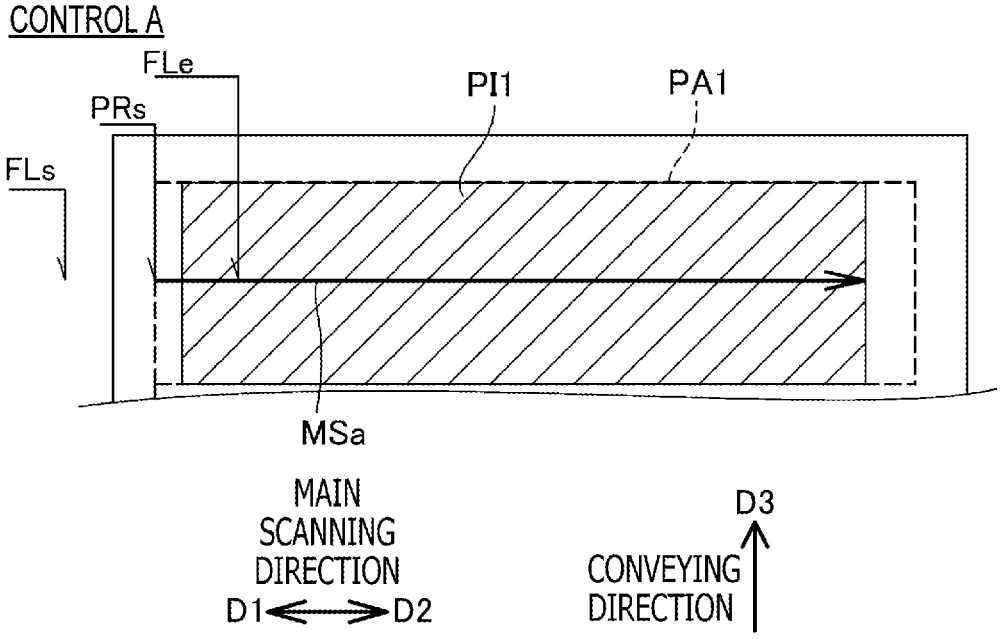
FIG. 9B illustrates scanning of a partial image in accordance with the control A.

As shown in FIG. 9B, in the control A, the main scan MSa from the printing start position PRs to the end of the partial image PI1 in the backward direction D2 is performed to print the partial image PI1.

A-5-2. Control B

Figure 10A:
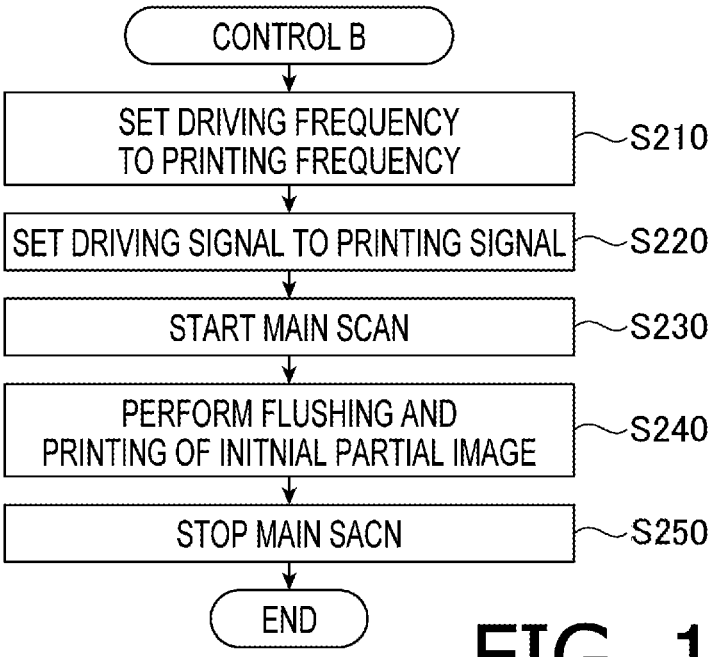
FIG. 10A is a flowchart illustrating a control B which is executed in the printing process.

FIG. 10A is a flowchart illustrating the control B at the beginning of printing. The control B is selected when the flushing amount V is a relatively small amount V1 (see FIG. 8). In S210 of FIG. 10A, the CPU 210 sets the driving frequency to the printing frequency. In S220, the CPU 210 sets the driving signal to the printing signal.

In S230, the CPU 210 controls the main scanning mechanism 130 to starts the main scanning in the backward direction D2. The main scanning is performed at the printing speed. In S240, the CPU 210 controls the head driving mechanism 120 to perform the flushing and formation of the first partial image PI1. For the flushing, among the printing signals, the large dot signal DSb (FIG. 4C) is used as the driving signal. Printing of the partial image PI1 is, as in the control A, performed by supplying the printing signals DSs, DSm and DSb to actuators of the nozzles NZ in accordance with the print data. In S250, the CPU 210 controls the head driving mechanism 120 to stop the main scanning in the backward direction D2. As above, the flushing and printing of the first partial image are completed.

Figure 10B:
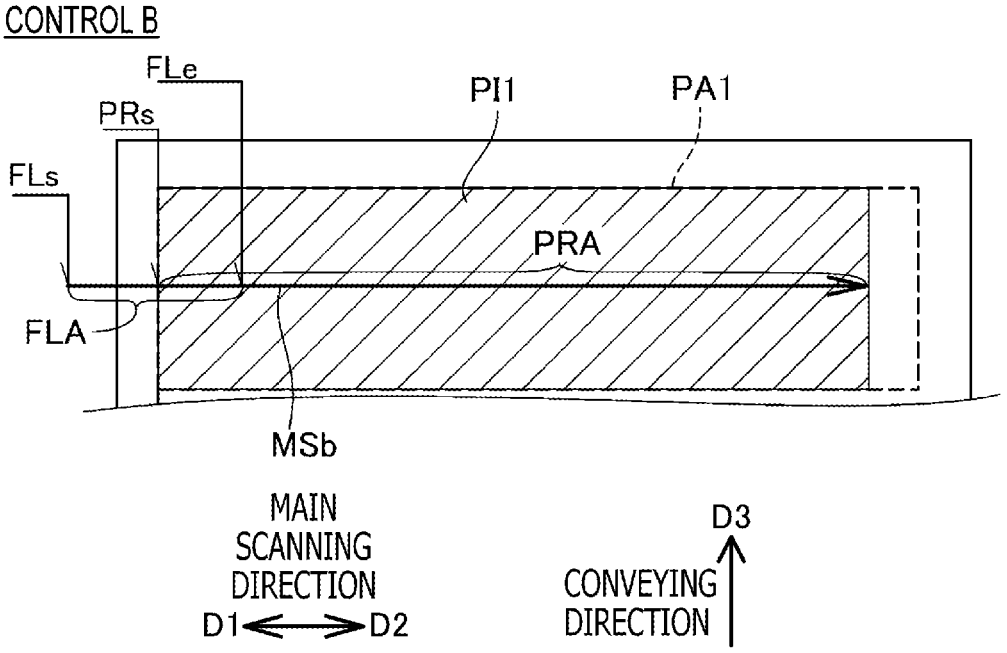
FIG. 10B illustrates scanning of a partial image in accordance with the control B.

As shown in FIG. 10B, in the control B, the main scan MSb in a range from the flushing start position FLs to the end of the partial image PI1 in the backward direction D2 is performed at the printing speed. Further, within a range of the main scan MSb, in a range FLA, which is a range from the flushing start position FLs to the flushing end position FLe, the flushing is performed. Further, within the range of the main scan MSb, which is a range from the printing start position PRs to the end of the partial image PI1 in the backward direction D2, printing of the partial image PI1 is performed. Thus, within the range of the main scan MSb, in a range from the printing start position PRs to the flushing end position FL3, both the flushing and the printing of the partial image PI1 are performed in parallel.

According to the control B, since the flushing and the printing of the partial image PI1 can be completed in one main scan MSb, it is possible to suppress lowering of the printing speed due to performing of the flushing. In particular, since both the flushing and the printing of the partial image PI1 are performed in parallel within the range PRA from the printing start position PRs to the end of the partial image PI1 in the backward direction D2, lowering of printing speed due to performing of the flushing can be suppressed.

A-5-3. Control C

Figure 11:
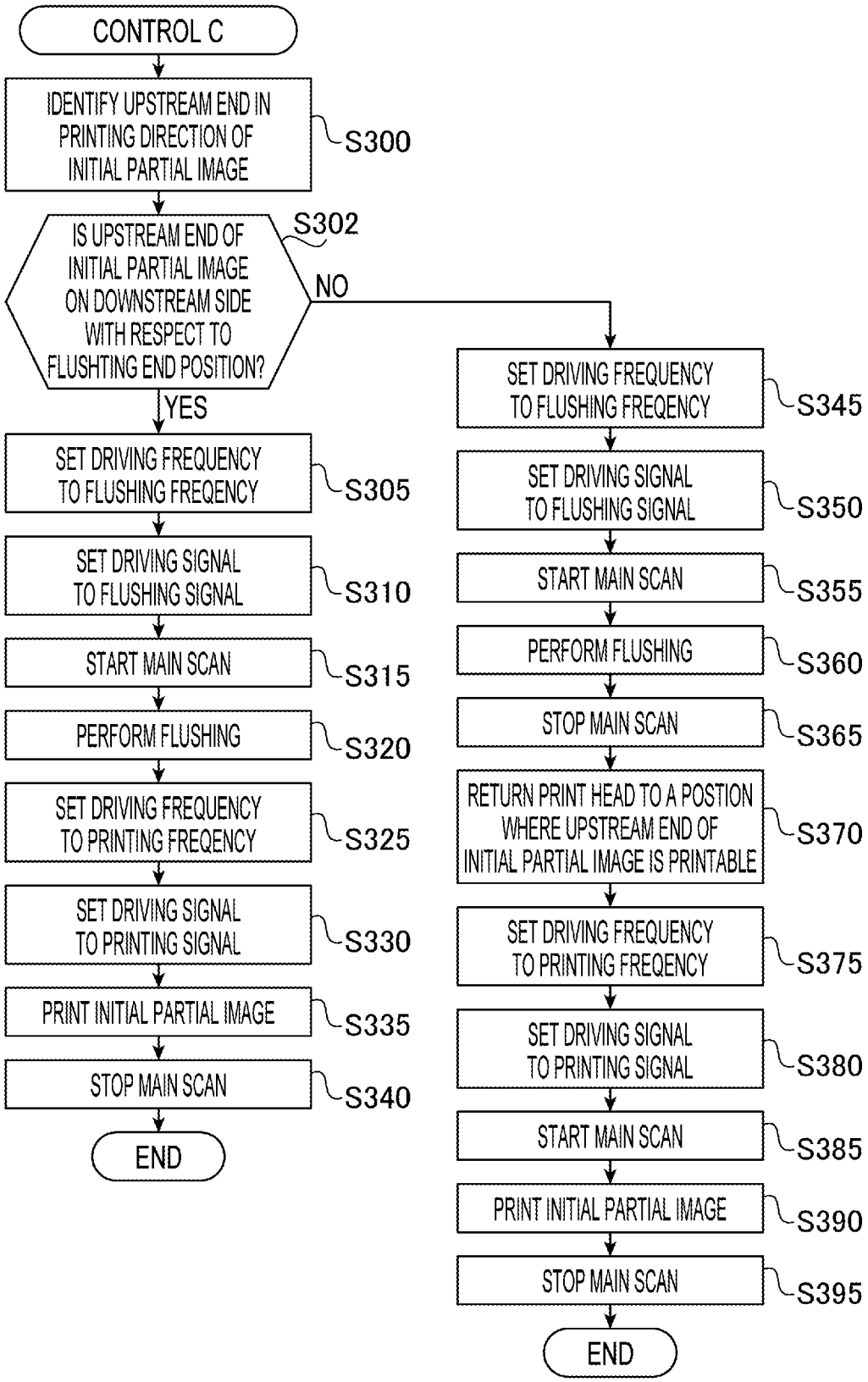
FIG. 11 is a flowchart illustrating a control C which is executed in the printing process.
Figure 12A:
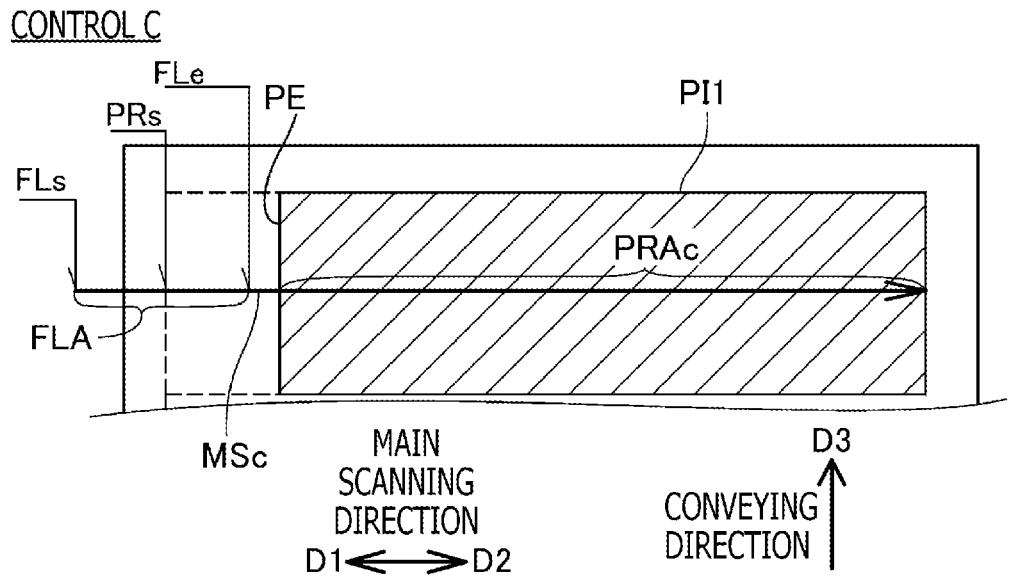
FIGS. 12A and 12B illustrate scanning of a partial image in accordance with the control C.
Figure 12B:
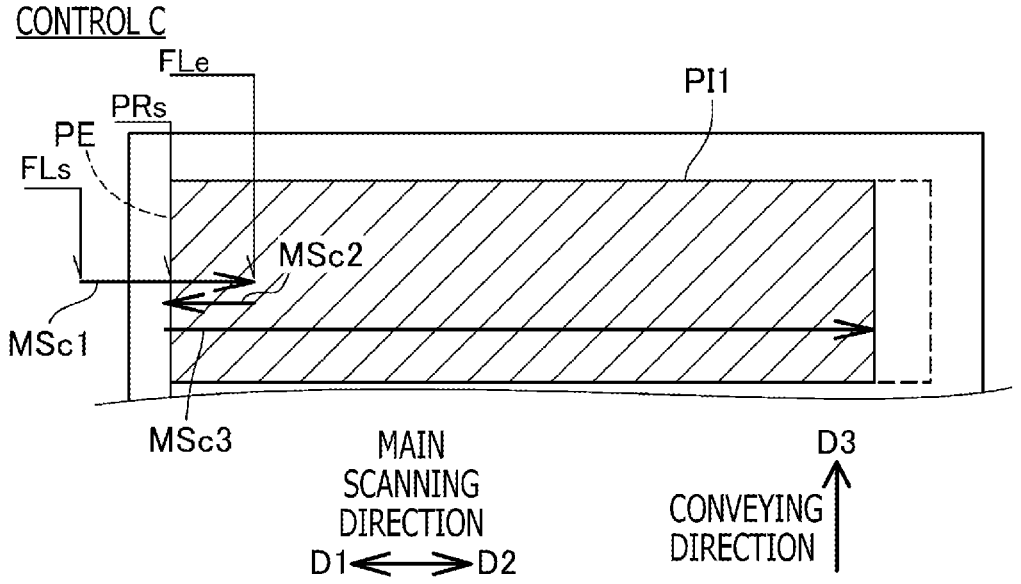

FIG. 11 is a flowchart illustrating the control C which is performed at the start of printing. FIGS. 12A and 12B show printing of a partial image when the control C is performed at the start of printing. It is noted that the Control C is selected when the flushing amount V is V2 which is larger than the amount V1 for which the control B is selected (FIG. 8).

In S300 of FIG. 11, the CPU 210 uses the partial print data, which indicates the partial image PI1 to be printed after execution of flushing in S320 and S360 (described later), among a plurality of pieces of print data, to identify an upstream end PE (i.e., the end in the forward direction D1) in the printing direction (i.e., the backward direction D2) of the first partial image PI1. For example, the CPU 210 uses the partial print data to identify the position of the dot to be formed in the most forward direction D1 side among the plurality of dots constituting the partial image PI1 as the position of the upstream end PE.

In S302, the CPU 210 determines whether the upstream end PE (the end in the forward direction D1) in the printing direction (in the backward direction D2) of the first partial image PI1 is on the downstream side (on the backward direction D2 side) with respect to the flushing end position FLe.

When the upstream end PE of the partial image PI1 is on the downstream side with respect to the flushing end position FLe (S302: YES), the CPU 210 performs processes in S305-S340. FIG. 12A shows an example in which the upstream end PE of the partial image PI1 is on the downstream side in the printing direction (i.e., the backward direction) with respect to the flushing end position FLe.

In S305, the CPU 210 sets the driving frequency to the flushing frequency. In S310, the CPU 210 sets the driving signal to the flushing signal DSf (FIG. 4D).

In S315, the CPU 210 controls the main scanning mechanism 130 to start the main scanning in the backward direction D2. The main scanning is performed at the printing speed. In S320, the CPU 210 controls the head driving mechanism 120 to perform flushing. At a time of completion of the flushing, the print head 110 is located at the flushing end position FLe.

In S325, the CPU 210 sets the driving frequency to the printing frequency. In S330, the CPU 210 sets the driving signal to the printing signal. That is, the driving frequency and the driving signal are switched from the frequency and signal for flushing to the frequency and signal for printing, respectively.

In S335, the CPU 210 controls the head driving mechanism 120 to print the first partial image PIs. That is, the head driving mechanism 120 causes the nozzles NZ to eject the ink Ik by supplying the printing signals DSs, DSm and DSb to the actuators of the nozzles NZ in accordance with the print data. In S340, the CPU 210 controls the head driving mechanism 120 to stop the main scan in the backward direction D2. Thus, the first partial printing is completed.

As shown in FIG. 12A, in the processes of S305-S340, which are parts of the processes of the control C, the main scan MSc from the flushing start position FLs to the end, in the backward direction D2, of the partial image PI1 is performed at the printing speed. Within a range of the main scan MSc, in the range FLA from the flushing start position FLs to the flushing end position FLe, the flushing is performed. Within the range of the main scan MSc, in a range PRAc, which is a range from the upstream end PE in the printing direction (i.e., the end in the forward direction D1) of the partial image PI1 to the downstream end in the printing direction (i.e., the end in the backward direction D2) of the partial image PI1, printing of the partial image PI1 is performed.

By the processes S305-S340 of the control C, the flushing and the printing of the partial image PI1 are completed with only one main scan MSc. Therefore, lowering of the printing speed due to performing of the flushing can be suppressed. Further, since the flushing is performed using the flushing frequency and the flushing signal DSf, more amount of ink Ik than that in the control B can be ejected for flushing, the flushing more effective than that according to the control B can be performed.

When the upstream end PE of the partial image PI1 is on the upstream side with respect to the flushing end position FLe (S302: NO), the CPU 210 performs processes of S345-S395. FIG. 12B shows an example in which the upstream end PE of the partial image PI1 is on the upstream side with respect to the flushing end position FLe.

In S345, the CPU 210 sets the driving frequency to the flushing frequency. In S350, the CPU 210 sets the driving signal to the flushing signal DSf (FIG. 4D).

In S355, the CPU 210 controls the main scanning mechanism 130 to start the main scanning in the backward direction D2. The main scanning is performed at the flushing speed. In S360, the CPU 210 controls the head driving mechanism 120 to perform flushing. When the flushing is completed, the print head 110 is located at the flushing end position FLe.

In S365, the CPU 210 controls the main scanning mechanism 130 to stop the print head 110 at the flushing end position FLe. In S370, the CPU 210 moves the print head 110 back, i.e. moves the print head 110 in the forward direction D1, to a position where the print head 110 can print the upstream end PE of the partial image PI in the printing direction.

In S375, the CPU 210 sets the driving frequency to the printing frequency. In S380, the CPU 210 sets the driving signal to the printing signal. That is, the driving frequency and driving signal are switched from the frequency and signal for flushing to the frequency and signal for printing, respectively.

In S385, the CPU 210 controls the main scanning mechanism 130 to start the main scanning in the backward direction D2 again. The main scanning is performed at the printing speed. In S390, the CPU 120 controls the head drive 120 to print the first partial image PI. That is, the head driving mechanism 120 supplies the printing signals DSs, DSm and DSb to the actuators of the nozzles NZ, thereby causing the nozzles NZ to eject the ink Ik. In S395, the CPU 210 controls the head driving mechanism 120 to stop the main scanning in the backward direction D2. Thus, the first partial printing is completed.

As shown in FIG. 12B, in the processes in S345-S395, which are parts of the processes in the control C, a main scan MSc1 in the backward direction D2 from the flushing start position FLs to the flushing end position FLe is performed at the flushing speed. Further, during the main scan MSc1, flushing is executed (S355-S365). After execution of the main scan MSc1, a main scan MSc2 in the forward direction D1 from the flushing end position FLe to a position, where the upstream end PE of the partial image PI1 can be printed, is performed (S370). After execution of the main scan MSc2, a main scan MSc3 in the backward direction D2 from a position where the upstream end PE of the partial image PI1 can be printed to an end in the backward direction D2 of the partial image PI1 is performed. During the main scan MSc3, printing of the partial image PI1 is performed (S385-S395).

According to the processes S345-S395 of the control C, the flushing is performed when the main scan MSc1 is being performed, and printing of the partial image PI1 is performed when the main scan MSc3 is being performed. As a result, both the flushing and the printing of the partial image PI1 are appropriately completed. Since the flushing is performed using the flushing frequency and the flushing signal DSf, a more amount of ink Ik can be ejected in the control C than in the control B for the flushing. Thus, more effective flushing can be performed in the control C than in the control B.

A-5-4. Control D

Figure 13:
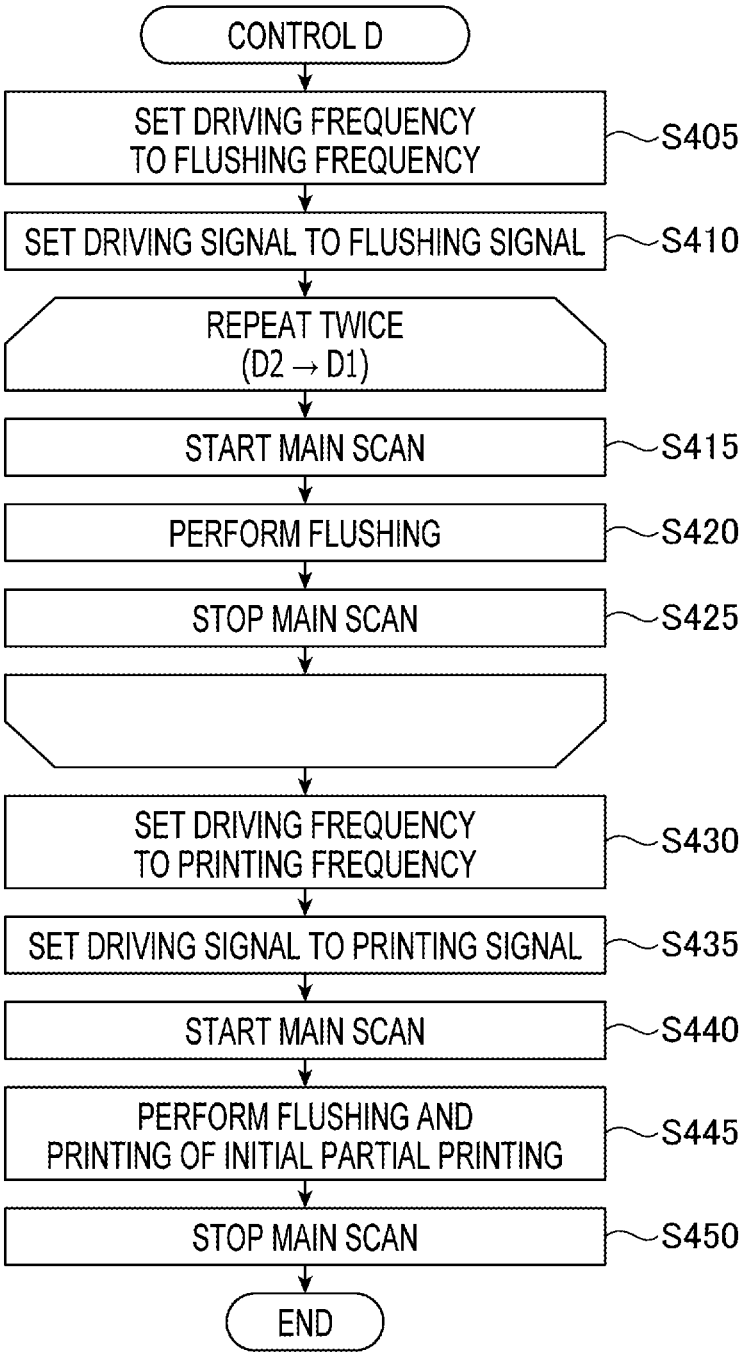
FIG. 13 is a flowchart illustrating a control D which is executed in the printing process.
Figure 14:
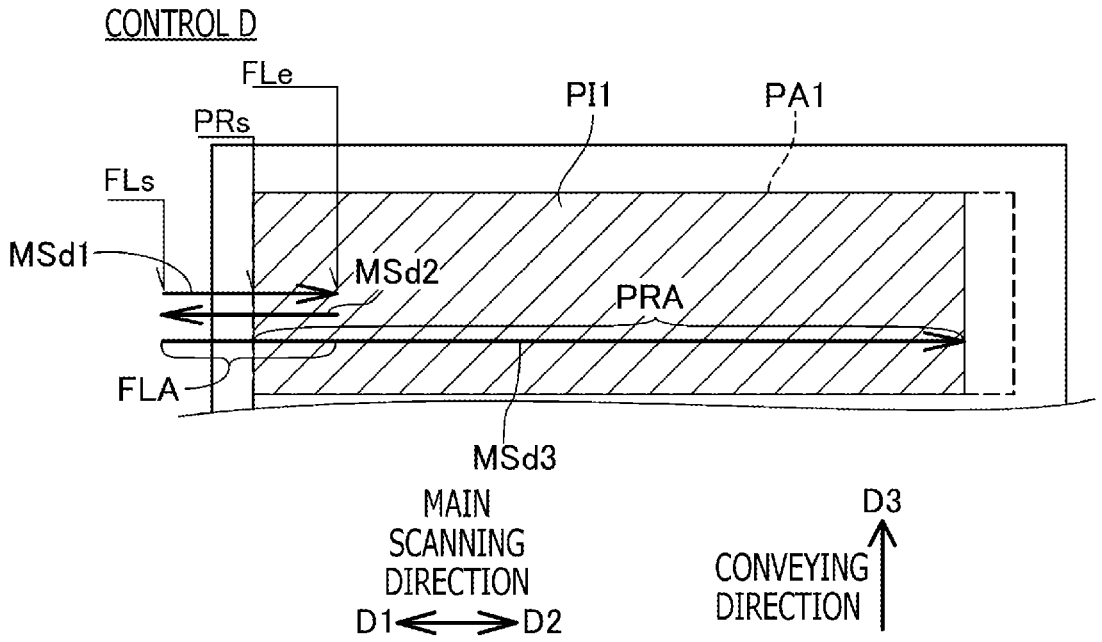
FIG. 14 illustrates scanning of a partial image in accordance with the control D.

FIG. 13 is a flowchart illustrating the control D at the start of printing. FIG. 14 illustrates the control D at the start of printing. The control D is selected when the flushing amount V is V3 which is more than the flushing amount in the control C (FIG. 8). In S405 of FIG. 13, the CPU 210 sets the driving frequency to the flushing frequency. In S410, the CPU 210 sets the driving signal to the flushing signal DSf (FIG. 4D).

The CPU 210 performs processes S415-S425 twice to perform the flushing in the two times of the main scanning, respectively. The first one is the main scanning in the backward direction D2, and the second one is the main scanning in the forward direction D1.

In S415, the CPU 210 controls the main scanning mechanism 130 to start the main scanning. The main scanning is performed at the flushing speed. In S420, the CPU 210 controls the head driving mechanism 120 to perform the flushing. In S425, the CPU 210 controls the main scanning mechanism 130 to stop the main scanning. When the first main scanning is completed, the print head 110 is located at the flushing end position FLe, while, when the second main scanning is completed, the print head 110 is located at the flushing start position FLs.

In S430, the CPU 210 sets the drive frequency to the printing frequency. In S435, the CPU 210 sets the driving signal to the printing signal. That is, the driving frequency and driving signal are switched from the frequency and signal for flushing to the frequency and signal for printing, respectively.

In S440, the CPU 210 controls the main scanning mechanism 130 to start the main scanning in the backward direction D2. The main scanning is performed at the printing speed. In S445, as in S240 of FIG. 10A, the CPU 210 controls the head driving mechanism 120 to perform flushing and printing of the first partial image PI1. For the flushing, among the printing signals, the large dot signal DSb (FIG. 4C) is used as the driving signal. Printing of the partial image PI1 is performed by supplying the printing signals DSs, DSm and DSb to the actuators of the nozzles NZ in accordance with the print data. In S450, the CPU 210 controls the head driving mechanism 120 to stop the main scanning in the backward direction D2. Thus, the flushing and the printing of the first partial image are completed.

As shown in FIG. 14, in the control D, the main scan MSd1, in the backward direction D2, from the flushing start position FLs to the flushing end position FLe is performed at the flushing speed, then the main scan MSd2, in the forward direction D1, from the flushing end position FLe to the flushing start position FLs is performed at the flushing speed. During the two times of main scan MSd1 and MSd2, the flushing is performed (S415-S425). After performing of the main scan MSd2, the main scan MSd3, in the backward direction D2, from the flushing start position FLs to the end, in the backward direction D2, of the partial image PI1 is performed. During the main scan MSd3, as is done during the main scan MSb shown in FIG. 10B, the flushing and printing of the partial image PI1 are performed (S440-S450). That is, within a range of the main scan MSd3, in a range FLA from the flushing start position FLs to the flushing end position FLe, the flushing is performed. Within the range of the main scan MSd3, in a range PRA from the printing start position PRs to the end, in the backward direction D2, of the partial image PI1, printing of the partial image PI1 is performed. Accordingly, within the range of the main scan MSb, in a range from the printing start position PRs to the flushing end position FLe, both the flushing and printing of the partial image PI1 are performed in parallel.

According to the control D, the flushing is performed in two times of the main scan MSd1 and MSd2, and both the flushing and the printing of the partial image PI1 are performed in the main scan MSc3. As a result, the flushing and the printing of the partial image PI1 can be appropriately completed. The flushing is performed using the flushing frequency and the flushing signal DSf in two times of main scanning and further, in the main scan MSd3. Accordingly, a greater amount of ink Ik can be ejected in the control D than in the control C, and more effective flushing can be performed in the control D than in the control C. Furthermore, in the main scan MSd3, the flushing and the printing of the partial image PI1 are performed in parallel. Therefore, lowering of the printing speed due to performing of the flushing can be suppressed.

A-5-5. Control E

Figure 15:
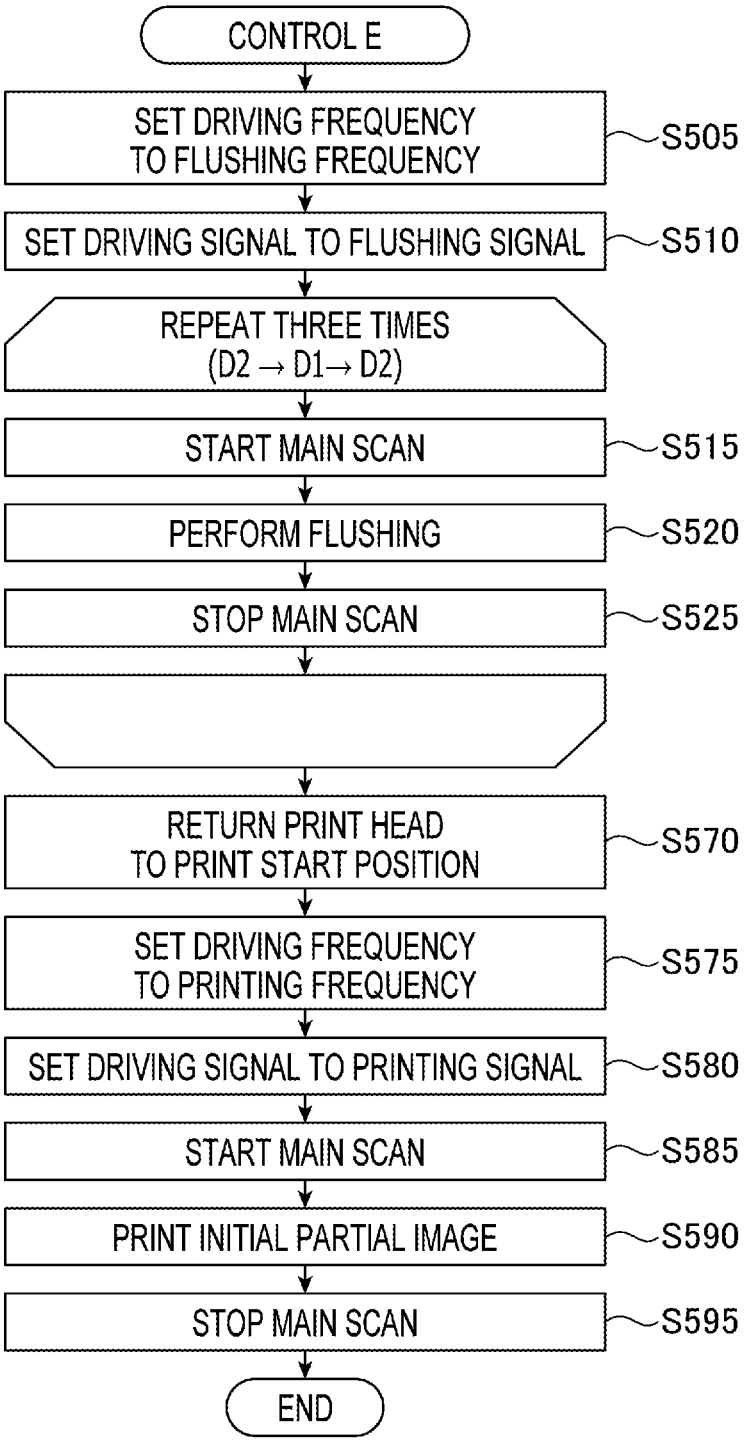
FIG. 15 is a flowchart illustrating a control E which is executed in the printing process.
Figure 16:
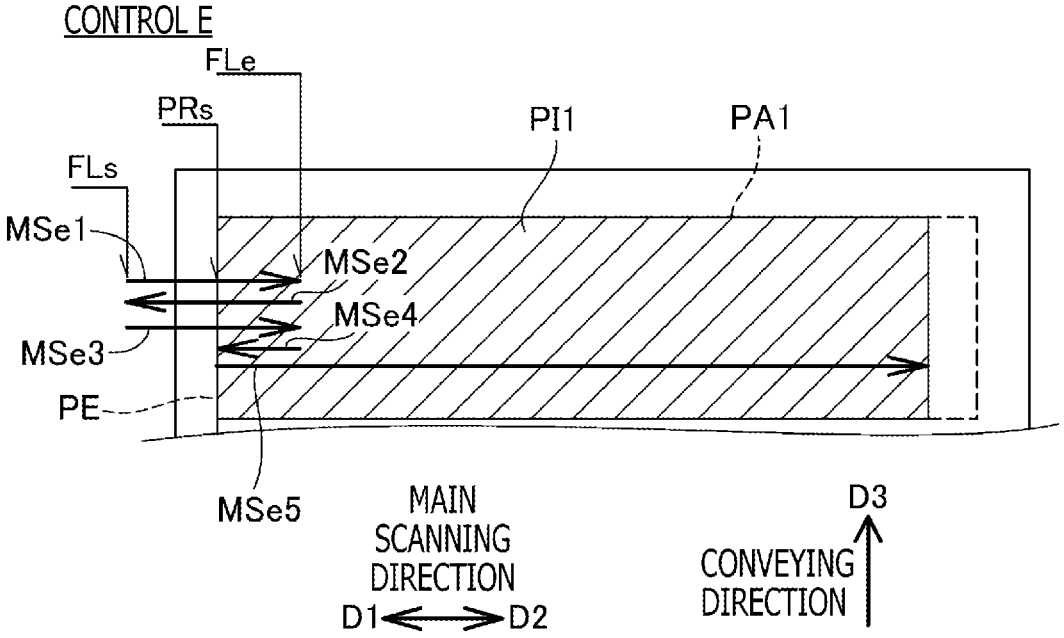
FIG. 16 illustrates scanning of a partial image in accordance with the control E.

FIG. 15 is a flowchart illustrating the control E at the start of printing. FIG. 16 illustrates the control E at the start of printing. The control E is selected when the flushing amount V is V4 which is more than the flushing amount in the control D (FIG. 8). In S505 of FIG. 15, the CPU 210 sets the driving frequency to the flushing frequency. In S510, the CPU 210 sets the driving signal to the flushing signal DSf (FIG. 4D).

The CPU 210 repeats the processes in S515-S525 three times and performs the flushing in each of the three times of the main scanning. The first main scanning is the main scanning in the backward direction D2, the second main scanning is the main scanning in the forward direction D1, and the third main scanning is the main scanning in the backward direction D2.

In S515, the CPU 210 controls the main scanning mechanism 130 to start the main scanning. The main scanning is performed at the flushing speed. In S520, the CPU 210 controls the head driving mechanism 120 to perform flushing. In S525, the CPU 210 controls the main scanning mechanism 130 to stop the main scanning. When the first main scanning is completed, the print head 110 is located at the flushing end position FLe, and when the second main scanning is completed, the print head 110 is located at the flushing start position FLs. When the third main scanning is completed, the print head 110 is located at the flushing end position FLe.

In S570, as in S370 of FIG. 11, the CPU 210 returns the print head 110 (i.e., moves the print head 110 toward the forward direction D1 side) to a position where the print head 110 can print the upstream end PE, in the printing direction, of the partial image PI. Incidentally, when the upstream end PE, in the printing direction, of the partial image PI is on the downstream side (i.e., the backward direction D2 side) with respect to the flushing end position FLe, S570 is omitted.

It is noted that processes in S575-S595 are the same as the processes in S375-S395 of FIG. 11. Therefore, description on the processes in S575-S595 will be omitted. As the processes in S575-S595 are performed, the first partial printing is completed.

As shown in FIG. 16, in the control E, main scans MSe1 and MSe3, in the backward direction D2, from the flushing start position FLs to the flushing end position FLe are performed at the flushing speed. Between the main scans MSe1 and MSe, a main scan MSe2, in the forward direction D1, from the flushing end position FLe to the flushing start position FLs is performed at the flushing speed. During the three main scans MSe1-MSe3, the flushing is performed (S515-S525). After the main scan MSe3, a main scan MSe4, in the forward direction, from the from the flushing end position FLe to the position where the upstream end PE of the partial image PI1 can be printed is performed (S570). After the main scan MSe4, a main scan MSe5, in the backward direction D2, from the position where the upstream end PE of the partial image PI1 can be printed to the end, in the backward direction D2, of the partial image PI1 is performed. During the main scan MSe5, printing of the partial image PI1 is performed (S585-S595).

According to the control E, the flushing is performed in the main scans MSe1-MSe3 and the printing of the partial images PI1 is performed in the main scan MSe5. As a result, the flushing and the printing of the partial image PI1 can be completed appropriately. Since the flushing is performed during three main scans MSe1-MSe3 using the flushing frequency and the flushing signal DSf, a larger amount of ink Ik can be ejected for the flushing in the control E than in the control D. Thus, the more effective flushing can be performed in the control E than in the control D.

According to the embodiment described above, the printing mechanism 100 is provide with the ink receiver 170 (FIG. 6) which is arranged within the movable range MR and on the forward direction D1 side with respect to the sheet range PR. The CPU 210 performs the first ejection control (S240 in FIG. 10A, S445 in FIG. 13) in which the flushing and the printing are performed in parallel by ejecting the ink from a plurality of nozzles while performing the main scan.

Specifically, the first ejection control includes a control in which, when the nozzle array NM or the nozzle array NC are located at a position corresponding to the ink receiver 170 and the nozzle array NK is located at a position corresponding to the sheet range PR (when the print head 110 is in a first state: see FIG. 6B and FIG. 6C), the flushing is performed by causing the nozzle array NM or NC to eject the magenta of the cyan ink Ik toward the ink receiver 170, and another control in which, during a period where the ink Ik is ejected toward the ink receiver 170 from the nozzle array NM or NC (i.e., during a period where the flushing of the nozzles NZ corresponding to the magenta or cyan ink is performed), the printing is performed by causing the nozzle array NK to eject the black ink Ik toward the sheet M. It is noted that the position of the nozzle array corresponding to the ink receiver or the sheet range is not the immediately above the ink receiver or the sheet range but a position at which the ink ejected from the nozzle array reaches the ink receiver or the sheet range. For example when the flushing is performed with the carriage being moved from the position above the sheet range toward the position above the ink receiver, the position of the nozzle array corresponding to the ink receiver is slightly shifted on the sheet range side with respect to the position immediately above the ink receiver since a reaching position of the ink ejected from the nozzle array while the carriage is being moved is shifted in the moving direction of the carriage.

As a result, according to the above configuration, since the flushing of the nozzles NZ corresponding to the magenta or cyan ink and the printing using the nozzle NZ corresponding to the black ink are performed in parallel, it is possible to suppress the printing time from being elongated when the flushing is necessary.

For example, if the ink receiver 170 is arranged at a position farther from the sheet range PR than in the above-described embodiment (e.g., when the distance ΔL in FIG. 6A is longer than the interval NL), the above-described first state (FIG. 6B or FIG. 6C) is not realized. Accordingly, in such a case, the first ejection control cannot be realized. In such cases, the flushing and the printing cannot be performed in parallel. According to the present embodiment, in comparison with such a case, the printing time can be shortened.

Further, even when the ink receiver 170 is configured as in the above-described embodiment, compared with a case where the flushing and the printing are performed separately as in the control C, the control B, which includes the first ejection control, can shorten the printing time since the total distance of the main scan is shortened.

Furthermore, according to the present embodiment, since the ink receiver 170 can be arranged in the vicinity of the sheet range PR, the size, in the main scanning direction, of the printing mechanism 100 can be reduced. Therefore, downsizing of the printing mechanism 100 can be realized.

Furthermore, in the present embodiment, when performing the flushing and the printing in parallel in the first state, the driving frequency is set to the printing frequency (S210 of FIG. 10A, S430 of FIG. 13). That is, when performing the flushing and the printing in parallel in the first state, the driving frequency for driving the nozzles NZ of the nozzle array NM or the nozzle array NC for flushing is the same as the driving frequency for driving the nozzles NZ of the nozzle array NK for printing.

As a result, when driving the nozzle arrays NM, NC, NY and NK with one driving frequency, while performing the printing appropriately, the flushing can be performed. If a flushing frequency different from the printing frequency is used, even if the flushing can be performed, the interval at which the dots are formed in the printing may not be controlled appropriately, and there is a possibility that the printing cannot be performed properly.

Further, if printing is performed at the flushing frequency, since the flushing frequency is lower than the printing frequency, it is necessary to reduce the main scanning speed, and therefore, the printing speed is lowered. According to this embodiment, it is possible to suppress such inconveniences. Further, since the nozzle arrays NM, NC, NY and NK are driven at one driving frequency, it is possible to suppress the configuration of the head driving mechanism 120 from being complicated. For example, if driving signals having different frequencies are to be supplied to the nozzle array NM and NC which perform flushing and to the nozzle array NK which performs the printing, two or more driving signal generating circuits and wiring therefor are required, and the configuration of the head drive unit 120 is complicated.

Furthermore, in the present embodiment, when performing the flushing and the printing in parallel in the first state, the driving signal is set to the printing signal (S220 in FIG. 10A, S435 in FIG. 13). That is, the driving signal for driving the nozzles NZ of the nozzle array NM or the nozzle array NC for flushing is equal to one of the printing signals DSs, DSm and DSb (the large dot signal DSb in this embodiment). As a result, since it is not necessary to supply the printing signals DSs, DSm and DSb, and the flushing signal DSf to the print head 110, simultaneously, it is possible to suppress the configuration of the head driving mechanism 120 from becoming complicated. When the printing frequency is used as the driving frequency, the maximum value of the wavelength of the driving signal that can be used is smaller than that when the flushing frequency is used as the driving signal. In such a case, if the flushing signal DSf is used, the wavelength of the driving signal may be too long and the ink Ik may not be ejected appropriately. According to the present embodiment, such inconvenience can be suppressed.

Further, according to the present embodiment, when the amount of the ink to be ejected for the flushing is more than V1, that is, when the flushing amount V is V2, V3 or V4, the CPU 210 performs controls C-E (FIG. 8). In each of the controls C-E, with performing the main scan, only the flushing is performed and the second ejection control in which the printing is not performed in parallel (S320 and S360 of FIG. 11, S420 of FIG. 13, S520 of FIG. 15). Concretely, the second ejection control is a control in which a plurality of kinds of nozzles are caused to eject the ink Ik toward the ink receiver 170, and none of the plurality of kinds of nozzles is caused not to eject the ink Ik toward the sheet M, when the mount of the ink to be ejected for the flushing is V1, the CPU 210 performs the control B (FIG. 8). In the control B, the CPU 210 performs the first ejection control (S240 of FIG. 10A) in which the printing is performed in parallel with the flushing. As a result, in accordance with the amount of the ink to be ejected for the flushing, an appropriate ejection control can be performed.

For example, in the second discharge control (S320 and S360 in FIG. 11, S420 in FIG. 13, S520 in FIG. 15), the flushing signal DSf is used for the flushing (S310 and S350 of FIG. 11, S410 in FIG. 13, S510 of FIG. 15). That is, the amount of ink ejected from one nozzle at one ejection in the second ejection control is more than the amount of ink ejected from one nozzle at one ejection in the first discharge control. As a result, when the amount of ink to be ejected for the flushing is more than V1, the controls C-E including the second ejection control are performed, and it is possible to efficiently perform the flushing.

Thus, for example, in the second ejection control, since the flushing signal DSf can be adopted and a large amount of ink Ik can be ejected efficiently. Therefore, the second ejection control is a control suitable for a case where the flushing amount V is relatively large. The ink ejection amount in the first ejection control is smaller than that of the first discharge control, but a decrease in the printing time is more suppressed in the second ejection control than in the second discharge control. Therefore, the second ejection control is a control suitable for a case where the flushing amount V is relatively small.

Further, in the control C described above (FIGS. 11 and 12), only the flushing is performed when the main scan MSc1 in the backward direction D2 is performed (S360 in FIG. 11), the main scan MSc2 for returning the print head 110 toward the forward direction D1 side is performed (S370), and thereafter, the printing of the partial images PI1 is performed with performing the main scan MSc3 in the backward direction D2. (S385-S395). That is, in the control C, the CPU 210 performs the second ejection control (i.e., the flushing) with performing the main scan MSc in the backward direction D2, the main scan MSc2 in the forward direction D1 after performing the second ejection control, and after the main scan MSc2, the third ejection control to perform printing of the partial image PI1 with performing the main scan MSc3 in the backward direction D2. As above, after the second ejection control in which only the flushing is performed, the print head 110 is returned toward the forward direction D1 side, thereby the printing in the vicinity of the end portion of the partial area PA1 on the forward direction D1 side being performed appropriately (see FIG. 12B). The same applies to S520, S570 and S590 of the control E (FIG. 15, FIG. 16).

Furthermore, in the above-described control C, the CPU 210 uses the partial image data representing the partial image PI1 to identify a position of the end, in the forward direction D1, of the partial image PI1 (i.e., the upstream end PE) (S300 in FIG. 11). When the upstream end PE is on the forward direction D1 side (i.e., on the upstream side) with respect to the reference position (i.e., the position FLe of the print head 110 when the flushing is finished, in this embodiment) based on the position of the print head 110 after execution of the second ejection control (flushing) (S302: NO), the main scan MSc2 in the forward direction D1 is performed (S370) after execution of the flushing as described above. When the upstream end PE is on the second direction side (i.e., the downstream side) with respect to the reference position (S302: YES), the fourth ejection control is performed without performing the main scan MSc2 in the forward direction D1. As a result, appropriate control can be performed according to the partial image PI1 to be printed after execution of the second ejection control (flushing). For example, when the upstream end PE is located on the second direction side (i.e., on the downstream side) with respect to the reference position, since the main scan MSc2 in the forward direction D1 is not performed, the time period for performing the printing can be suppressed.

In the control D (FIGS. 13 and 14) which is executed when the flushing amount V is V3 that is greater than V1, the CPU 210 performs only the flushing with performing two main scans MSd1 and MSd2 (S415-S425), and then, executes a control to perform the flushing and the printing with performing the main scan MSd3 (S440-S450). That is, the first ejection control is executed after the second ejection control has been executed twice. As a result, by executing the second ejection control and the first ejection control in a combined manner, even the flushing amount V is relatively large, it is possible to suppress the printing time from being elongated.

Further, in the above embodiment, the control D (FIGS. 13 and 14) is executed in a first case (specifically, a case where the flushing amount V is V3) among the cases where the flushing amount V is larger than V1, and the control C (FIGS. 11 and 12) is executed in a second case (specifically, a case where the flushing amount V is V2) among the cases where the flushing amount V is larger than V1 (FIG. 8). In the control D, CPU 210 performs the main scan MSd2 in the forward direction D1 while performing only the flushing (S415-S425), and then performs the control of performing the flushing and the printing in parallel with performing the main scan MSd3 in the backward direction D2 (S440-S450). In the control C, the CPU 210 performs only the flushing (S315, S320 or S355-S565) with performing the main scan MSc or MSc1 in the backward direction D2, and then performs the printing of the partial images PI1 (S335 or S385-S395) with performing the main scan MSc or MSc3 in the backward direction D2, without performing the flushing and the printing in parallel.

That is, in the first case, the second ejection control is executed with performing the main scan in the forward direction D1, and then the first ejection control is executed with performing the main scan in the backward direction D2. In the second case, the second ejection control is executed with performing the main scan in the backward direction D2, and thereafter, the partial image PI1 is printed with performing the main scan in the backward direction D2 without performing the first ejection control. As a result, when the flushing amount V is larger than V1, appropriate flushing according to the flushing amount V and printing of the partial image PI1 can be performed by appropriately executing the control (e.g., control D) of executing the second ejection control in combination with the first ejection control or the control (e.g., control C) of executing only the second ejection control.

As described above, the nozzles NZ of the black nozzle array NK of the above embodiment are examples of a first type nozzles, and the nozzles NZ of the magenta and cyan nozzle arrays NM and NC are examples of a second type nozzle. Further, the forward direction D1 is an example of a first direction, and the backward direction D2 is an example of a second direction.

B. Modifications (1) In the above embodiment, the ink receiver 170 is arranged on the forward direction D1 side of the movable range MR with respect to the sheet range PR. Alternatively, the ink receiver may be arranged on the backward direction D2 side of the sheet range PR. In such a case, for example, the first ejection control may be performed in a state where the black nozzle array NK, which is on the backward direction D2 side among the plurality of nozzle arrays NK, NY, NC and NM, is located at a position corresponding to the ink receiver, and the magenta and cyan nozzle arrays NM and NC, which are on the forward direction D1 side, are located at positions corresponding to the sheet range PR.

The first ejection control of this modification includes a control of performing the flushing by causing the black nozzle array NK to eject the ink Ik, and a control of performing printing by causing the magenta/cyan nozzle arrays NM and NC to eject the ink Ik to the sheet M in this state.

Therefore, in this modification, the nozzles NZ of the black nozzle array NK are examples of the second type nozzle, and the nozzles NZ of the magenta and cyan nozzle arrays NM and NC are examples of the first type nozzles. Further, the forward direction D1 is an example of the second direction, and the backward direction D2 is an example of the first direction.

(2) The arrangement order of the plurality of nozzle arrays NK, NY, NC and NM in the above embodiment is an example, and aspects of the present disclosures should not be limited to this order. That is, the arrangement order of the nozzle arrays, from the backward direction D2 side to the forward direction D1 side, may be different from the that of the above-described embodiment. The plurality of nozzle arrays may be, for example, six nozzle arrays including a nozzle array for ejecting light cyan ink Ik and a nozzle array for ejecting light magenta ink Ik in addition to the four nozzle arrays described above.

Alternatively, the plurality of nozzle arrays may be seven nozzle arrays including three additional nozzle arrays NC2, NM2 and NY2 for the C, M and Y inks in addition to the four nozzle arrays described above. In such a case, the seven nozzle arrays may be arranged in the order of NM2, NC2, NY2, NK, NY, NC and NM, for example, from the backward direction D2 side toward the forward direction D1 side.

The plurality of nozzle arrays may be a plurality of nozzle arrays of the same color, for example, a plurality of nozzle arrays of the black ink. Further, when the ink receiver 170 is arranged on the forward direction D1 side with respect to the sheet range PR, the first ejection control may be executed such that, in a state where at least the nozzle array arranged at the most forward direction D1 side is located at a position corresponding to the ink receiver 170 and at least the nozzle array arranged at the most backward direction D2 side is located at a position corresponding to the sheet range PR, the flushing of at least the nozzle array arranged at the most forward direction D1 side and the printing using at least the nozzle array arranged at the most backward direction D2 side are performed in parallel.

(3) In the above embodiment, the flushing is performed when the printing is started. Alternatively, the flushing may be performed when the printing on a sheet M is being performed. For example, in the main scan in the forward direction D1 when the partial printing for printing the partial image PI2 of FIG. 5 is performed, the first ejection control may be performed in which the printing of an image in the vicinity of an end in the forward direction D1 of the partial image PI and the flushing are performed in parallel.

Similarly, in the main scan in the backward direction D2 when the partial printing for printing the partial image PI5 of FIG. 5 is performed, the first ejection control may be executed in which the printing of an image in the vicinity of an end in the forward direction D1 of the partial image PI and the flushing are performed in parallel.

Further, when the printing is continuously performed on a plurality of sheets M, the similar controls A-E as in the present embodiment may be executed at the start of printing of the second and subsequent sheets M.

(4) In the embodiment described above, the head driving mechanism 120 supplies the driving signals to the actuators of the nozzles NZ of the nozzle arrays NK, NY, NC and NM using the driving frequency which is used commonly among the nozzle arrays NK, NY, NC and NM.

Alternatively, the head driving mechanism 120 may provide drive signals using different driving frequencies for respective nozzle arrays. In this case, when the first ejection control is executed, the head driving mechanism 120 may supply the driving signal to the nozzle array (e.g., the nozzle array NC in FIG. 6B) subjected to the flushing using the flushing frequency and the flushing signal DSf, and may supply the driving signal to the nozzle array (e.g., the nozzle array NK in FIG. 6B) subjected to the printing using the printing frequency and the printing signal. In this case, the configuration of the head driving mechanism 120 may be complicated compared to the present embodiment, but the amount of ink ejected by the flushing can be increased, and thus, more efficient flushing can be performed.

(5) The printing process of the above embodiment is only an example, and could be modified appropriately. For example, in the above-described embodiment, five types of controls A-E are selectively used, but the present invention is not limited to such a configuration. For example, the configuration may be modified such that the flushing is always performed when the printing is started, and the control A is not necessarily selected.

Among the controls B-E for performing the flushing, only a part of the controls may be performed. For example, the control for performing flushing may be a two-step control of the control C and the control D. In such a case, the control B in which only the first ejection control is performed is not executed, but only the control C, in which only the second ejection control is executed, and the control D, in which the first ejection control and the second ejection control are combined, are performed.

Alternatively, the control for performing flushing may be one type of control including the first ejection control, for example, only one of the control B and the control D.

(6) In the embodiment described above, the flushing amount V and the control regarding the flushing are switched according to the elapsed time Ta from the previous flushing (FIG. 8). Alternatively, the flushing amount V and the control regarding the flushing may be switched in accordance with an index different from the elapsed time Ta, for example, a usage amount of the ink Ik after execution of the previous flushing, the number of the printed sheets after execution of the previous flushing. When the flushing is performed both when the printing is started and during the printing, different indexes may be used when the printing is started and during the printing.

(7) The above-described configuration of the ink receiver 170 is only an example, and aspects of the present disclosures should not be limited to the above configuration. The ink receiver 170 may be configured such that an ink absorbing member such as sponges is arranged at a position corresponding to the ejection range FA of the ink receiver 170 of the embodiment. The ink absorbing member does not have to be inclined as in the ink receiver 170 of the above-described embodiment, and may have an upper surface parallel to the main scanning direction.

(8) Instead of the sheet M, another deformable medium, for example, an OHP film, may be used as the printing medium.

(9) In the above-described embodiments, the device that performs the printing process shown in FIG. 7 is the CPU 210 of the printer 200. Alternatively, the apparatus that performs the printing process may be another type of apparatus, for example, the terminal device 300. In this case, for example, the terminal device 300 operates as a printer driver by executing a driver program, and controls, functioning as a part of the function as the printer driver, the printer 200 serving as a print execution unit to execute printing.

In this case, the terminal device 300 may realize controlling of the printer 200 by, for example, transmitting a main scan command indicating a stopping position and a speed of the print head 110, a conveyance command indicating a conveying amount of the sheet M, and a command indicating executing the flushing to the printer 200 together with the partial print data.

(10) The apparatus that executes the printing process shown in FIG. 7 may be, for example, a server configured to acquire image data from the printer 200 or the terminal apparatus 300, generate the above-described commands and/or print data using the image data, and transmit the commands and/or print data to the printer 200. Such a server may be configured by a plurality of computers which are capable of communicating with each other via a network.

(11) In each of the above embodiments, a part of the configuration realized by hardware may be replaced with software, and conversely, a part or all of the configuration realized by software may be replaced with hardware. For example, some of the printing processes of FIG. 7 may be implemented by dedicated hardware circuits (e.g., ASIC) that operate in accordance with CPU 210 instructions.

Although the present invention has been described above based on examples and modifications, the above-described embodiments of the present invention are intended to facilitate understanding of aspects of the present disclosures, and are not intended to limit the same. Aspects of the present disclosures may be modified and/or improved without departing from aspects of the disclosures, and equivalents thereof are included in the aspects of the present disclosures.

The technique disclosed in the present disclosures can be realized in various forms, such as a control device of a printing execution device, a control method of the printing execution device, a printing method, a computer program for realizing the functions of these devices and methods, a non-transitory computer-readable recording medium in which the computer-readable instructions (e.g., computer programs) are recorded, and the like.

What is claimed is:

1. A printing apparatus, comprising:

a print head having a plurality of types of nozzles including a first type of nozzles configured to eject ink and a second type of nozzles configured to eject ink;

a main scanning mechanism configured to perform main scanning of moving the print head along a first direction and a second direction being opposite to the first direction with respect to a printing medium;

a conveyer configured to convey, relative to the print head, the print medium along a conveying direction intersecting both the first direction and the second direction;

an ink receiver arranged on the first direction side with respect to a medium range in which the printing medium is conveyed by the conveyer, the medium range being a particular range in both the first direction and second direction in which the print head is configured to move; and a controller configured to control the print head, the main scanning mechanism and the conveyer, wherein the second type of nozzles are positioned on the first direction side with respect to the first type of nozzles, wherein the controller is configured to perform a first ejection control with performing the main scanning, the first ejection control including a control of performing flushing by causing the second type of nozzles to eject the ink toward the ink receiver when the print head is in a first state where the second type of nozzles are located within a flushing range corresponding to the ink receiver and the first type of nozzles are located within the medium range, a control of causing the first type nozzles to eject the ink toward the printing medium during a period in which the ink is ejected from the second type of nozzles toward the ink receiver when the print head is in the first state, and wherein an ink ejection amount per one ink ejection operation when the flushing is performed is larger than an ink ejection amount per one ink ejection operation when the first type nozzles eject the ink toward the printing medium.

2. The printing apparatus according to claim 1, wherein a driving frequency used to drive the second type of nozzles to perform the flushing when the print head is in the first state is equal to a driving frequency used to drive the first type of nozzles to perform the printing.

3. The printing device according to claim 2, wherein the driving signal used to drive the second type of nozzles to perform the flushing when the print head is in the first state is equal to any of one or more driving signals used to drive the first type of nozzles to perform the printing.

4. The printing apparatus according to claim 1, wherein the controller is configured to perform a second ejection control to perform the flushing by ejecting ink from the plurality of types of nozzles toward the ink receiver when an amount of ink to be ejected for the flushing is larger than a reference amount, none of the plurality of types of nozzles being caused not to eject the ink toward the printing medium during a period where the ink is ejected from any of the plurality of types of nozzles toward the ink receiver, and wherein when an amount of the ink to be ejected to perform the flushing is equal to or smaller than a reference amount, perform the first ejection control instead of the second ejection control.

5. The printing apparatus according to claim 4, wherein the amount of ink ejected from one nozzle in one ejection in the second ejection control is larger than the amount of ink ejected from one nozzle in one ejection in the first ejection control.

6. The printing apparatus according to claim 4, wherein the second ejection control is a control causing the second type of nozzles to eject the ink toward the ink receiving portion when the print head is in the first state and not to eject the ink from the first type of nozzles when the print head is in the first state while performing the main scan in the second direction, wherein the controller is configured to perform the main scan in the first direction after execution of the second ejection control, and a third ejection control after the main scan in the first direction, and wherein the third ejection control includes a control of performing, when the print head is in the first state, the printing by causing the first type of nozzles to eject the ink toward the printing medium while performing the main scanning in the second direction.

7. The printing apparatus according to claim 6, wherein the controller is further configured to identify a position of an end of the partial image in the first direction using partial image data indicating a partial image to be printed after execution of the second ejection control, wherein when the end of the partial image in the first direction is on the first direction side with respect to a reference position based on a location of the print head after execution of the second ejection control, the main scan in the first direction after execution of the second ejection control, the third ejection control after execution of the main scan in the first direction, wherein when the end of the partial image in the first direction on the second direction side with respect to the reference position, a fourth ejection control without performing the main scanning in the first direction after execution of the second ejection control, and wherein the fourth ejection control is a control to perform the printing by causing the plurality of nozzles to eject the ink toward the printing medium while performing the main scan in the second direction.

8. The printing apparatus according to claim 4, wherein, when the amount of the ink to be ejected for the flushing is larger than a reference amount, the controller is configured to execute the first ejection control after executing the second ejection control one or more times.

9. The printing apparatus according to claim 8, wherein the controller is configured to perform in a first case among cases where the amount of the ink to be ejected for the flushing is larger than a reference amount, the second ejection control with performing the main scan in the first direction, and after execution of the second ejection control with performing the main scan in the first direction, the first ejection control with performing the main scan in the second direction; and in a second case among the cases where the amount of the ink to be ejected for the flushing is larger than the reference amount, the second ejection control with performing the main scan in the second direction, and after execution of the second ejection control with performing the main scan in the second direction, a control of causing the plurality of types of nozzles to eject the ink toward the printing medium with performing the main scan in the second direction without performing the first ejection control to perform printing.

10. The printing apparatus according to claim 1, wherein the controller is configured to perform the second ejection control of performing the flushing by causing the plurality of types of nozzles to eject the ink toward the ink receiver, wherein, during a period in which the ink is ejected from any of the plurality of types of nozzles toward the ink receiver, none of the plurality of types of nozzles is caused to eject the ink toward the printing medium, and after execution of the second ejection control, executing the first ejection control.

11. A non-transitory computer-readable recording medium storing instructions to be executed by a controller of a printing apparatus, the printing apparatus including print head having a plurality of types of nozzles including a first type of nozzles configured to eject ink and a second type of nozzles configured to eject ink, a main scanning mechanism configured to perform main scanning of moving the print head along a first direction and a second direction being opposite to the first direction with respect to a printing medium, a conveyer configured to convey, relative to the print head, the print medium along a conveying direction intersecting both the first direction and the second direction, an ink receiver arranged on the first direction side with respect to a medium range in which the printing medium is conveyed by the conveyer, the medium range being a particular range in both the first direction and second direction in which the print head is configured to move, the second type of nozzles being positioned on the first direction side with respect to the first type of nozzles, wherein the instructions, when executed by the controller, cause the printing apparatus to perform an obtaining function of obtaining image data, and a control function of controlling the print head, the main scanning mechanism, and the conveyer according to the image data, the control function being a first ejection control of causing the plurality of nozzles to eject the ink while performing the main scanning, the first ejection control including a control of performing the flushing by causing the second type of nozzles to eject the ink toward the ink receiver when the print head is in a first state in which the second type of nozzles are located within a flushing range corresponding to the ink receiver and the first type of nozzles are located within the medium range, and a control of performing printing by causing the first type of nozzles to eject the ink toward the print medium during a period where the ink is ejected from the second type of nozzles toward the ink receiver when the print head is in the first state, wherein an ink ejection amount per one ink ejection operation when the flushing is performed is larger than an ink ejection amount per one ink ejection operation when the first type of nozzles eject the ink toward the printing medium.

12. The printing apparatus according to claim 1, wherein the flushing range and the medium range are separated by a predetermined distance along the first direction and the second direction.

13. The non-transitory computer-readable recording medium according to claim 11, wherein the flushing range and the medium range are separated by a predetermined distance along the first direction and the second direction.

* * * * *